US007056237B2

(12) United States Patent
Slavey et al.

(10) Patent No.: US 7,056,237 B2
(45) Date of Patent: Jun. 6, 2006

(54) PORTABLE BASKETBALL REBOUND APPARATUS AND METHOD

(75) Inventors: Douglas Slavey, Sycamore, OH (US); John G. Joseph, Upper Sandusky, OH (US)

(73) Assignee: Shoot-A-Way, Inc., Upper Sandusky, OH (US)

( * ) Notice: Subject to any disclaimer, the term of this patent is extended or adjusted under 35 U.S.C. 154(b) by 0 days.

(21) Appl. No.: 10/384,131

(22) Filed: Mar. 7, 2003

(65) Prior Publication Data

US 2004/0176192 A1 Sep. 9, 2004

(51) Int. Cl.
*A63B 69/00* (2006.01)

(52) U.S. Cl. ..... 473/433; 473/422

(58) Field of Classification Search ..... 473/422, 473/433–434, 439, 445, 447–449, 472, 479–488
See application file for complete search history.

(56) References Cited

U.S. PATENT DOCUMENTS

| | | | | | |
|---|---|---|---|---|---|
| 4,538,808 | A | * | 9/1985 | Holland | 473/447 |
| 4,667,957 | A | | 5/1987 | Joseph | |
| 4,697,810 | A | | 10/1987 | Mathison | |
| 4,786,371 | A | | 11/1988 | Postol | |
| 4,838,549 | A | | 6/1989 | Woodall | |
| 5,016,875 | A | | 5/1991 | Joseph | |
| 5,160,138 | A | * | 11/1992 | Sanders | 473/438 |
| 5,485,993 | A | * | 1/1996 | Lipsett | 473/448 |
| 5,527,185 | A | * | 6/1996 | Davis | 473/438 |
| 5,540,428 | A | | 7/1996 | Joseph | |
| 5,676,120 | A | | 10/1997 | Joseph | |
| 5,681,230 | A | * | 10/1997 | Krings | 473/433 |
| 5,800,291 | A | * | 9/1998 | Grover | 473/447 |
| 5,823,898 | A | * | 10/1998 | Wang | 473/483 |
| 6,213,899 | B1 | * | 4/2001 | Maske | 473/409 |
| 6,224,503 | B1 | | 5/2001 | Joseph | |
| 6,348,028 | B1 | * | 2/2002 | Cragg | 482/148 |
| 6,458,049 | B1 | * | 10/2002 | Bush | 473/433 |
| 6,579,197 | B1 | * | 6/2003 | Benoit | 473/447 |
| 6,679,794 | B1 | * | 1/2004 | Vitello et al. | 473/433 |
| 6,733,403 | B1 | * | 5/2004 | Courtright | 473/433 |

OTHER PUBLICATIONS

Club Court adjustable basketball system, Model Nos. BA832 and BA833, Bison, Inc., St. Lincoln, Nebraska, undated.

McCall's Rebounder, Sorenson Christian Industries, Inc., Highway 210 West, Angier, North Carolina 27501, undated.

Portable system, Schutt Sports, Wichita Falls, Kansas, undated.

Pro-Fold and Quick-Pro, Probound Sports, Dorrance, Kansas, undated.

* cited by examiner

*Primary Examiner*—Mitra Aryanpour
(74) *Attorney, Agent, or Firm*—Jacox Meckstroth & Jenkins

(57) ABSTRACT

A portable basketball practice system or apparatus and method are shown having a plurality of pads situated on a plurality of adjustable arms that provide a toggle assembly, respectively. A position of the pads can be adjusted relative to a box-out area and can be engaged by a player during a basketball practice or training session. After a pad is engaged and driven away from the box-out area, the other pad is driven toward the box-out area. The player experiences a predetermined amount of resistance in order to simulate "boxing out" during a rebound drill. The apparatus and method may be provided separately or integrally with a basketball backboard and hoop. The apparatus and method may also include or be used with a rebounder so that the player can simulate "boxing out" before, during or after capturing a rebound.

65 Claims, 16 Drawing Sheets

PORTABLE BASKETBALL REBOUND APPARATUS AND METHOD

BACKGROUND OF THE INVENTION

1. Field of the Invention

This invention relates to devices used for basketball practice shooting and, more particularly, to an apparatus and method for practicing boxing during a rebound of a basketball.

2. Description of Prior Art

Please In the past, a number of devices have been used to facilitate basketball practice shooting and rebounding. Such devices include surface supportable apparatus that returns consecutive shots to a basketball player or players standing at various locations and distances from the basketball board and hoop. U.S. Pat. Nos. 4,697,810, 4,786,371, 4,838,549, 5,540,428, 5,676,120, 4,667,957 and 6,224,503 are examples of such devices.

Other prior art training aids include the McCall's rebounder which supports a basketball above the ground so that a player can practice "pulling" the rebound down. The McCall's device is available from Sorensen Christian Industries, Inc., Highway 210 West, Angier, N.C. 27501.

Further, various portable basketball units have been provided for recreation and home use and these include the Model Nos. BA833 and BA832 Club Court adjustable basketball system available from Bison, Inc. of St. Lincoln, Nebr. at www.bisoninc.com; models Pro-Fold and Quick-Pro available from Probound Sports of Dorrance, Kans. and the portable system available from Schutt Sports of Wichita Falls, Kans.

Although each of the devices taught in the aforementioned patents and products available are characterized by specific features generally beneficial to a basketball player who desires to improve his skills, there remains a need for a more efficient portable and collapsible basketball rebounding apparatus that permits a player to practice "boxing out" an opponent player during a rebound.

SUMMARY OF THE INVENTION

It is, therefore, a primary object of the invention to provide an apparatus and method for enabling a player to practice "boxing out" during a rebound training or practice exercise.

In one aspect, this invention comprises a basketball practice system comprising a base, at least one support coupled to the base, a rebounder coupled to the at least one support for supporting a basketball above the around; a resistance assembly coupled to the at least one support; the resistance assembly comprising a first resistance member that provides a predetermined amount of resistance to a player when the player engages the at least one resistance member, the first resistance member moving in a substantially non-vertical direction when the player engages the first resistance member with a force that exceeds the predetermined amount of resistance.

In another aspect, this invention comprises a basketball practice system comprising: a base, at least one support coupled to the base, a resistance assembly coupled to the at least one support, the resistance assembly comprising a first resistance member that provides a predetermined amount of resistance to a player when the player engages the at least one resistance member, the first resistance member moving in a substantially non-vertical direction when the player engages the first resistance member with a force that exceeds the second predetermined amount of resistance, wherein the resistance assembly comprises a second resistance member that provides a second predetermined amount of resistance to a player when the player engages the second resistance member, the second resistance member moving substantially non-vertically when the player engages the second resistance member with a force that exceeds the predetermined amount of resistance, wherein the first and second resistance members are coupled to a pivot member that permits both of the first and second resistance members to pivot about a pivot axis when the player engages either of the first and second resistance members, and wherein when the player engages one of the first or second resistance members to move the one of the first or second resistance members to a boxed-out position away from a box-out area, the other of the first or second resistance members moves toward the box-out area.

In another aspect, the invention comprises a basketball practice apparatus comprising a base, a support extending upward away from the base and comprising a backboard and rim situated above the ground in proximity to a box-out area, a rebounder coupled to the support for supporting a basketball above the ground; and a box-out apparatus associated with the box-out area, the box-out apparatus permitting a player to simulate boxing out a second player or shooting under pressure from the second player by providing at least one resistance member that yields to the player when the player applies a predetermined amount of pressure to the at least one resistance member, the at least one resistance member moving substantially laterally in any direction when the player engages the at least one resistance member with a force that exceeds the predetermined force.

In still another aspect, this invention comprises a basketball practice apparatus comprising: a base, a support extending upward away from the base and comprising a backboard and rim situated above the ground in proximity to a box-out area, and a box-out apparatus associated with the box-out area, the box-out apparatus permitting a player to simulate boxing out a second player or shooting under pressure from the second player by providing at least one resistance member that yields to the player when the player applies a predetermined amount of pressure to the at least one resistance member, the at least one resistance member moving substantially laterally in any direction when the player engages the at least one resistance member with a force that exceeds the predetermined force, wherein the box-out apparatus comprises a first resistance member and a second resistance member, each providing a predetermined amount of resistance to the player when the player engages the first and second resistance members, the first and second resistance members are coupled to a pivot member that permits both of the first and second resistance members to pivot about a pivot axis when the player engages either of the first and second resistance members, and wherein when the player engages one of the first or second resistance members to move the one of the first or second resistance members to a boxed-out position away from the box-out area, the other of the first or second resistance members moves toward the box-out area.

In still another aspect, this invention comprises: a basketball practice apparatus comprising: a base, a support extending upward away from the base and comprising a backboard and rim situated above the ground in proximity to a box-out area, and a box-out apparatus associated with the box-out area, the box-out apparatus permitting a player to simulate boxing out a second player or shooting under pressure from the second player by providing at least one resistance member that yields to the player when the player applies a predetermined amount of pressure to the at least one resistance member, the at least one resistance member moving substantially laterally in any direction when the player engages the at least one resistance member with a force that exceeds the predetermined force, wherein the box-out apparatus comprises a first resistance member and a second resistance member, each providing a predetermined amount of resistance to the player when the player engages the first and second resistance members, the first and second resistance members are coupled to a pivot member that permits both of the first and second resistance members to pivot about a pivot axis when the player engages either of the first and second resistance members, and wherein the pivot member causes the one of the first or second resistance members to remain in the boxed-out position in response to the player engaging the one of the first or second resistance members.

In yet another aspect, this invention comprises a basketball practice apparatus comprising: a base, a support extending upward away from the base and comprising a backboard and rim situated above the ground in proximity to a box-out area, and a box-out apparatus associated with the box-out area, the box-out apparatus permitting a player to simulate boxing out a second player or shooting under pressure from the second player by providing at least one resistance member that yields to the player when the player applies a predetermined amount of pressure to the at least one resistance member, the at least one resistance member moving substantially laterally in any direction when the player engages the at least one resistance member with a force that exceeds the predetermined force, wherein the box-out apparatus comprises a first resistance member and a second resistance member, each providing a predetermined amount of resistance to the player when the player engages the first and second resistance members, the first and second resistance members are coupled to a pivot member that permits both of the first and second resistance members to pivot about a pivot axis when the player engages either of the first and second resistance members, and wherein the pivot member causes the one of the first or second resistance members to remain in the boxed-out position in response to the player engaging the one of the first or second resistance members while causing the other of the first or second resistance members to remain in an engagement-ready position relative to the box-out area.

In another aspect, the invention comprises a method for improving rebounding skills, comprising the steps of: providing a base comprising a support extending upward away from the base and comprising a backboard and hoop situated above the ground in proximity to a box-out area, the support also having a rebounder for supporting a basketball above the ground; providing a box-out apparatus associated with the box-out area, and enabling a player to simulate boxing out a second player by providing at least one resistance member that yields to the player when the player applies a predetermined amount of pressure to the at least one resistance member, the at least one resistance member moving in a substantially non-vertical or lateral direction when the player engages the at least one resistance member with a force that exceed the predetermined force either before or after said player obtains or receives said basketball from said rebounder.

In still another aspect, this invention comprises a method for improving rebounding skills, comprising the steps of: providing a base comprising a support extending upward away from the base and comprising a backboard and hoop situated above the ground in proximity to a box-out area, and providing a box-out apparatus associated with the box-out area, enabling a player to simulate boxing out a second player by providing at least one resistance member that yields to the player when the player applies a predetermined amount of pressure to the at least one resistance member, the at least one resistance member moving in a substantially non-vertical or lateral direction when the player engages the at least one resistance member with a force that exceeds the predetermined force, wherein the resistance assembly comprises a first resistance member and a second resistance member, each providing a predetermined amount of resistance to the player, each of the first resistance members and the second resistance members yielding in a substantially non-vertical or lateral direction when the player engages them, and coupling the support to a pivot member that permits both of the first and second resistance members to pivot about a pivot axis when the player engages either of the first and second resistance members and locking the first and second resistance member to the pivot member, wherein when the player engages one of the first or second resistance members to move the one of the first or second resistance members to a boxed-out position away from the box-out area, the other of the first or second resistance members move toward the box-out area.

In yet another aspect, this invention comprises a method for improving rebounding skills, comprising the steps of: providing a base comprising a support extending upward away from the base and comprising a backboard and hoop situated above the ground in proximity to a box-out area, providing a box-out apparatus associated with the box-out area, wherein the box-out apparatus comprises a first resistance member and a second resistance member, each providing a predetermined amount of resistance to the player, each of the first resistance members and the second resistance members yielding in the substantially non-vertical or lateral direction when the player engages them, enabling a player to simulate boxing out a second player by providing at least one resistance member that yields to the player when the player applies a predetermined amount of pressure to the at least one resistance member, the at least one resistance member moving in a substantially non-vertical or lateral direction when the player engages the at least one resistance member with a force that exceeds the predetermined force, and coupling the support to a pivot member that permits both of the first and second resistance members to pivot about a pivot axis when the player engages either of the first and second resistance members and locking the first and second resistance member to the pivot member, and wherein the pivot member causes the one of the first or second resistance members to remain in a boxed-out position in response to the player engaging the one of the first or second resistance members.

In still another aspect, this invention comprises a method for improving rebounding skills, comprising the steps of: providing a base comprising a support extending upward away from the base and comprising a backboard and hoop situated above the ground in proximity to a box-out area, providing a box-out apparatus associated with the box-out area, wherein the box-out apparatus comprises a first resistance member and a second resistance member, each providing a predetermined amount of resistance to the player, each of the first resistance members and the second resistance members yielding in a substantially non-vertical or lateral direction when the player engages them, enabling a player to simulate boxing out a second player by providing at least one resistance member that yields to the player when the player applies a predetermined amount of pressure to the at least one resistance member, the at least one resistance member moving in a substantially non-vertical or lateral direction when the player engages the at least one resistance member with a force that exceeds the predetermined force, and coupling the support to a pivot member that permits both of the first and second resistance members to pivot about a pivot axis when the player engages either of the first and second resistance members and locking the first and second resistance member to the pivot member, and wherein the pivot member causes the one of the first or second resistance members to remain in a boxed-out position in response to the player engaging the one of the first or second resistance members while causing the other of the first or second resistance members to remain in an engagement-ready position relative to the box-out area.

In still another aspect, the invention comprises a rebound apparatus comprising: a base having a support; a toggle member secured to the support; a plurality of pads secured to the toggle member in operative relationship with a box-out area in proximate relationship with a rim of a basketball backboard; and the toggle member permitting a player to engage one of the plurality of pads and to move one of said plurality of pads away from the hoop and away from the box-out area when the player applies a predetermined amount of force to the one of the plurality of pads and simultaneously permitting the other of the plurality of pads to move close to the hoop and the box-out area.

These and other objects and advantages of the invention will be apparent from the following description, the accompanying drawings and the appended claims.

BRIEF DESCRIPTION OF ACCOMPANYING DRAWING

DETAILED DESCRIPTION OF PREFERRED EMBODIMENT

Figure 1:
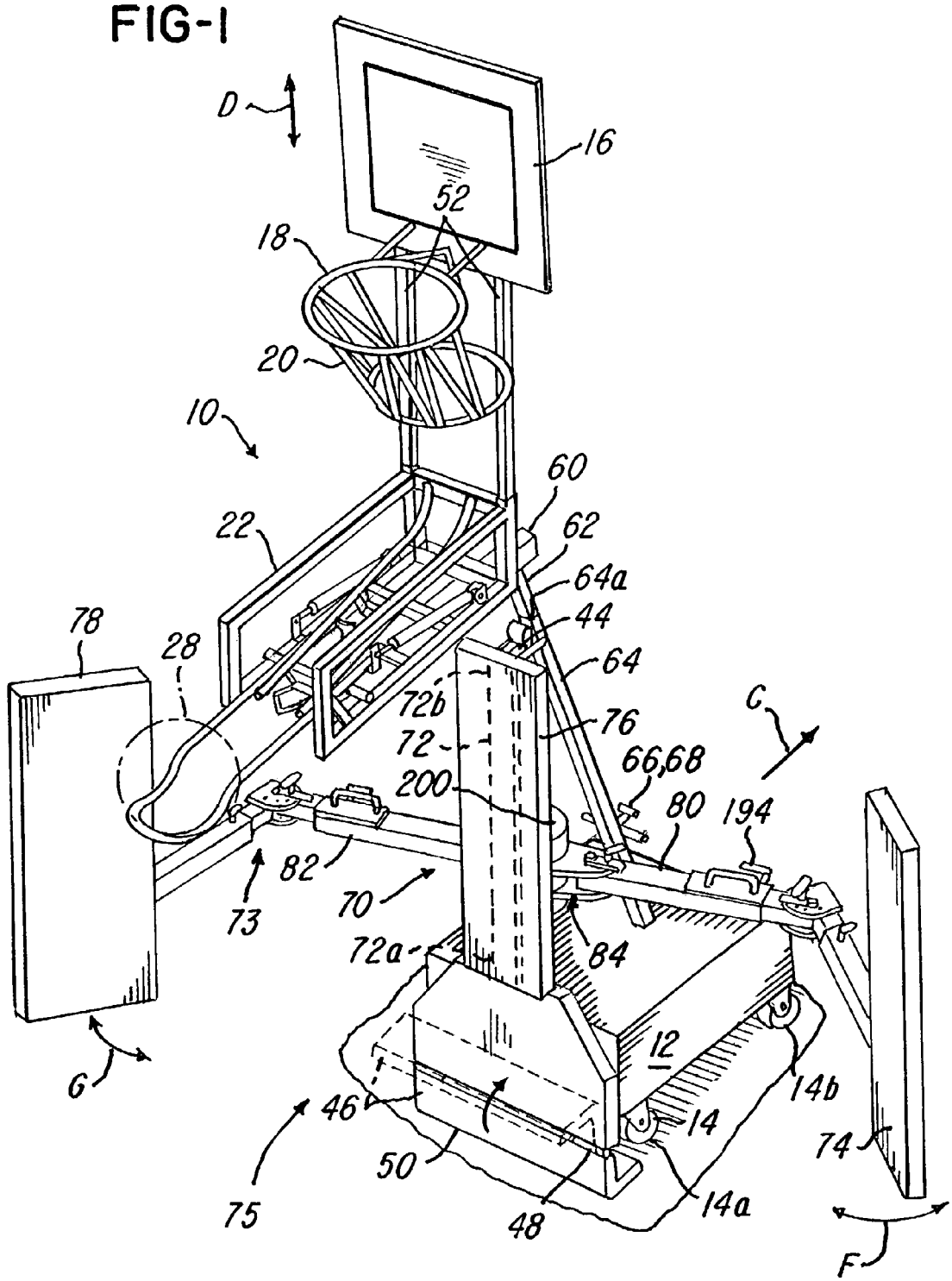
FIG. 1 is a perspective view of a basketball system and apparatus in accordance with one embodiment of the invention.
Figure 3:
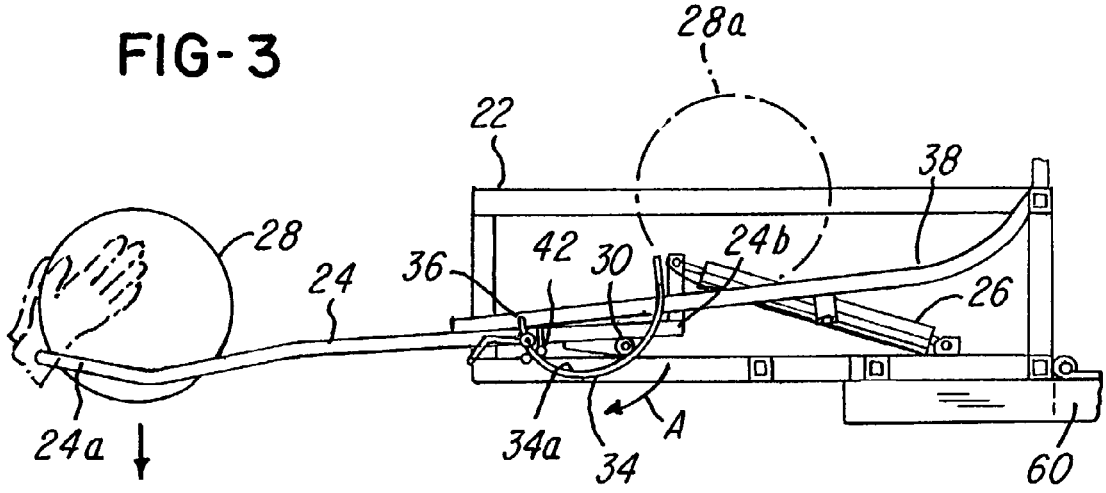
FIG. 3 is a fragmentary view showing details of a rebounder that may be used with the box-out assembly.
Figure 4:
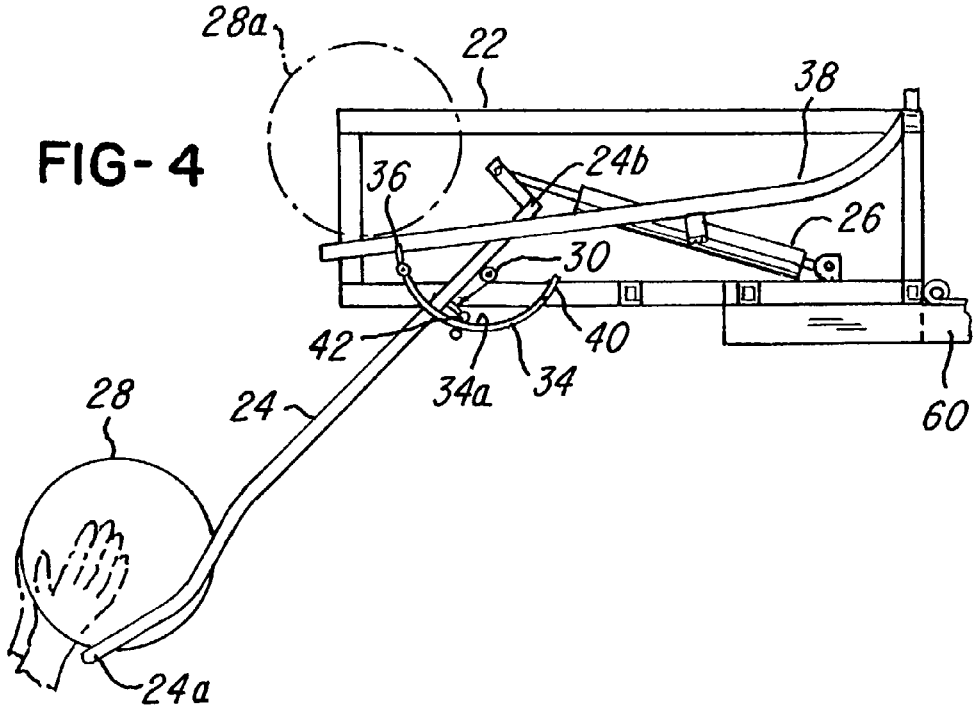
FIG. 4 is another fragmentary view of the rebounder shown in FIG. 3, illustrating a player pulling down a rebound.

Referring now to FIGS. 1–13, a portable basketball rebound practice system 10 is shown. The system 10 comprises a base 12 having a plurality of wheels or casters 14 that make the system 10 moveable and portable across a playing surface, such as a hardwood floor of an indoor basketball court or the blacktop or cement surface of an outdoor basketball court. The system 10 can be used adjacent to and/or in conjunction with a basketball backboard and hoop that is supported from above or below. In the embodiment described, the system 10 comprises a backboard 16 having an associated basketball hoop 18 and net 20 that feeds basketballs into a rebounder 22 (FIGS. 1, 3 and 4). In the embodiment being described, the rebounder 22 may be of the type offered by the assignee hereof or could comprise a McCall's rebounder available from Sorensen Christian Industries, Inc. of Angier, N.C.

Referring now to FIGS. 3 and 4, further details of one suitable rebounder 22 will now be described. It should be understood, however, that the system 10 could be used with or without the rebounder 22. The rebounder 22 is shown in FIGS. 3 and 4 as comprising a rebounding arm or carriage 24 having a carriage end 24*a* for receiving and supporting a basketball 28 a predetermined distance above the ground. The rebounding arm or carriage 24 is pivotally secured by a pin 30 and comprises a second end 24*b* coupled to a solenoid 26, as illustrated in FIGS. 3 and 4. An arcuate pivoting stop 34 has a first end 36 coupled to a basketball track 38 which receives a plurality of basketballs 28, 28*a*. Note that basketball 28*a* is retained and prevented from moving towards the carriage 24 when rebounding arm or carriage 24 is in the home position illustrated in FIGS. 1 and 3. As the rebounding arm or carriage 24 is pulled or moved downward towards the ground, as illustrated in FIG. 4, during a rebounding practice session, a second post 42 rides along an inner wall surface 34*a* of arcuate pivoting stop 34 which, in turn, causes end 40 to move in the direction of arrow A (FIG. 3). This releases basketball 28*a* where it rolls from the position shown in phantom view a cradle end 24*a*.

Referring back to FIGS. 1 and 2, note that the base 12 is of sufficient weight, such as in excess of 300 pounds, so that when the casters 14 are in a locked position, the system 10 is capable of resisting movement during engaging contact from one or more players who are using the system 10. The base 12 may comprise a pivoting base support 46 which pivots about axis of pivot support 48 to cause the front wheels or casters 14*a* to be raised a predetermined distance above the ground, while rear casters 14*b* remain on the ground. The pivot support 46 engages the ground so that a substantial amount of weight from system 10 is focused along edge 50 (FIG. 1). This, in turn, provides further resistance from preventing the system 10 from moving in the direction of arrow C (FIG. 1) when the system 10 is being used by a player P. Although not shown, the axis or pivot support 48 may be locked into the position shown in FIG. 1. When not in use, the pivot support 48 may be pivoted to a storage position shown in phantom view in FIG. 1, thereby permitting the system 10 to be moved and positioned at various places on a supportive surface or moved to a position where the system 10 may be stored.

In the embodiment being described, the backboard 16 is mounted onto the rebounding device 22 with a plurality of support posts 52. For storage convenience, the backboard 16, hoop 18 and rebounding device 22 may be mounted on a pivotal support that permits the backboard 16 to be locked into the position shown in FIG. 1, but which permits the backboard to pivot downward (as viewed in FIG. 18), thereby reducing the overall height of the system 10. This facilitates storing the device. It is also contemplated that the pivot support may permit the backboard and rebounding device to swivel at least 180 degrees so that the backboard 16, rebounding device 22 and hoop 18 face rearward (as viewed in FIG. 1). Once in the rearward position, the pivot support then permits the device to pivot downward as mentioned. This facilitates not only storing the system 10, but also enables the system 10 to be positioned underneath an existing basketball backward so that the player P can practice rebounding or shooting with resistance with an existing hoop, such as a hoop mounted from a wall, ceiling or pole.

It should be understood that the aforementioned backboard 16, hoop 18 and rebounding device 22 are mounted on support 60 and the support 60 is mounted on an elongated tubular member 62 that telescopes from a support tubular member 64. The tubular member 62 telescopes in and out of the support tubular member 64 in a conventional manner so that the basketball hoop 18, backboard 16 and rebounding device 22 may be moved up and down in the direction of double arrow D (FIG. 1) in order to adjust a position of these parts to a predetermined position or distance from the ground. The tubular member 62 and tubular support member 64 each have a plurality of holes which may be aligned so as to receive locking means or a locking pin 66 having a handle 68 in order to lock the basketball hoop 18 and rebounding device 22 into the predetermined position. The system 10 is capable of accommodating players of different skill levels, ages, sexes and the like because the position of the various components (including the hoop 18, backboard 16, rebounder 22 and a box-out assembly 70 described later herein) is adjustable.

The system 10 further comprises a support post 72 having a first end 72*a* secured to the base 12 and a second end 72*b* secured to the tubular support member 64. The box-out assembly or rebound resistance system 70 is secured to support post 72. The box-out assembly 70 has a first adjustable wing or arm 80 supporting a first pad 74 and a second adjustable wing or arm 82 that supports a second pad 78. The adjustable arms 80 and 82 may be tubular as shown. A third pad 76 may be situated on support post 72.

The adjustable wings or arms 80 and 82 each comprise a plurality of telescoping members, described below, that are mounted on a cam or pivot assembly 84 that is secured to support post 72. A pivot assembly 84 adjustably couples the adjustable arms or wings 80 and 82 together and also permits the wings or adjustable arms 80 and 82 to toggle or pivot in the direction of arrows F and G (FIG. 1). Thus, as will be described and shown relative to FIGS. 8–14, the adjustable arms 80 and 82 can toggle back and forth towards and away from a box-out area 75.

Referring back to FIG. 1, notice that the cam or pivoting assembly 84 may comprise a cover 200 if desired. Features of the pivot assembly 84 and adjustable arms 80 and 82 will now be described relative to FIG. 2.

The wing or adjustable arm 80 comprises a first pad adjustment assembly 71 and the second wing or arm 82 comprises a second pad adjustment assembly 73. The adjustable arms 80 and 82 comprise ends 80*a* and 82*a*, respectively, that are secured to cam or pivoting assembly 84. For ease of description and illustration, the adjustable arm 80 and the first pad adjustment assembly 71 will be described in detail, and it should be understood that the arm 82 and the second pad adjustment assembly 73 comprises like parts that operate and function in the same manner.

Figure 2:
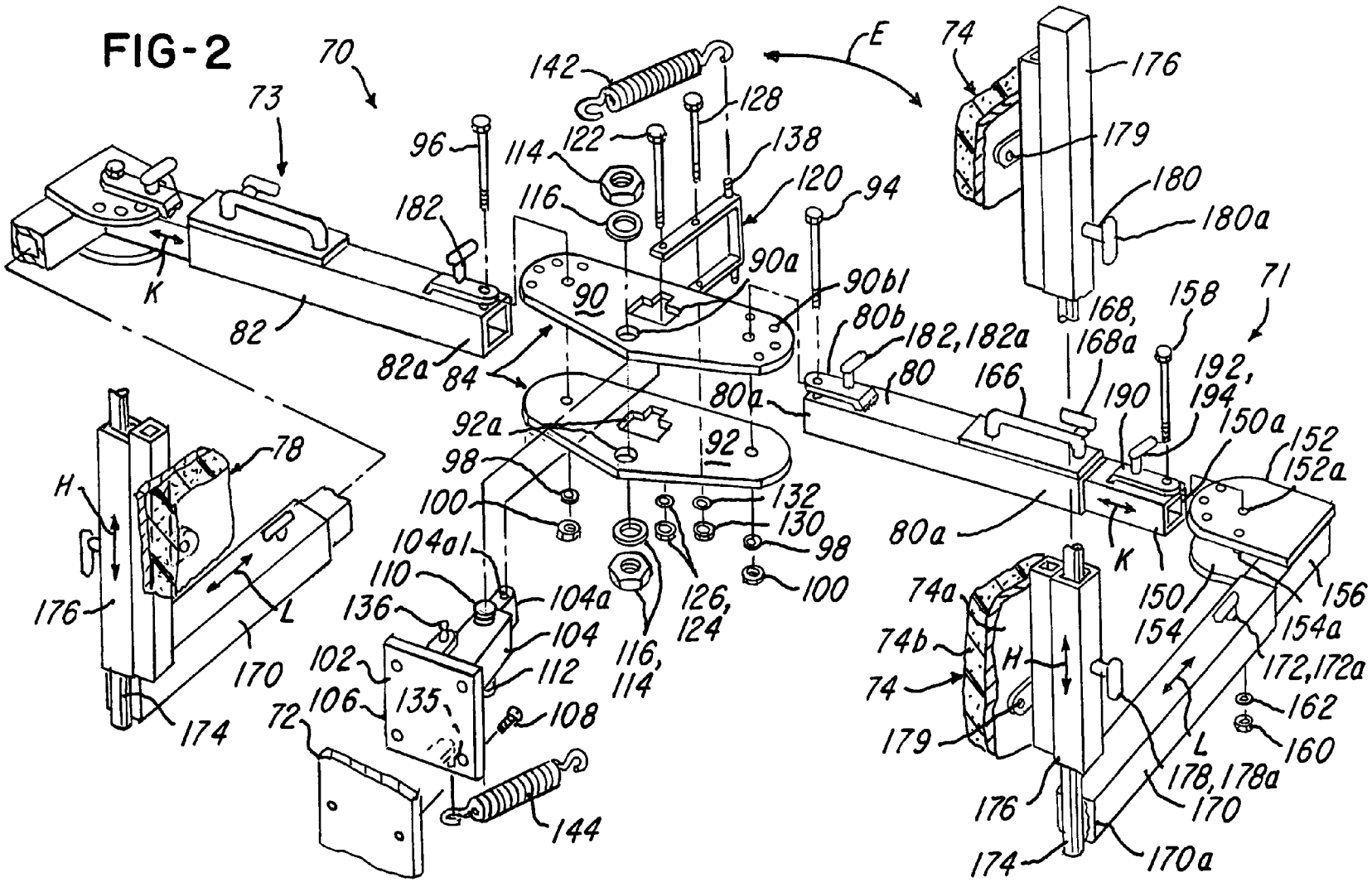
FIG. 2 is an exploded view of a box-out assembly comprising a supporting a plurality of pads.

Referring to FIG. 2, the assembly 84 comprises a first cam plate 90 and an opposed cam plate 92 secured to ends 80*a* and 82*a* with a pair of bolts 94 and 96 and associated washers 98 and nuts 100, as shown.

The cam plates 90 and 92 are pivotally mounted on a support bracket 120 having a support extension 104 that is mounted to a planar member 106. The planar member 106 is mounted directly to the primary support post 72 (FIG. 1) with bolts or screws 108. It should be understood that apertures 90*a* of cam plate 90 and aperture 92*a* of cam plate 92 are dimensioned such that the cam or pivoting assembly 84 may pivot about an axis defined by threaded posts 110 and 112 in the manner described later herein relative to FIGS. 5–13. Bolts 114 and washers 116 are used to secure plates 90 and 92 to posts 110 and 112.

Figure 2A:
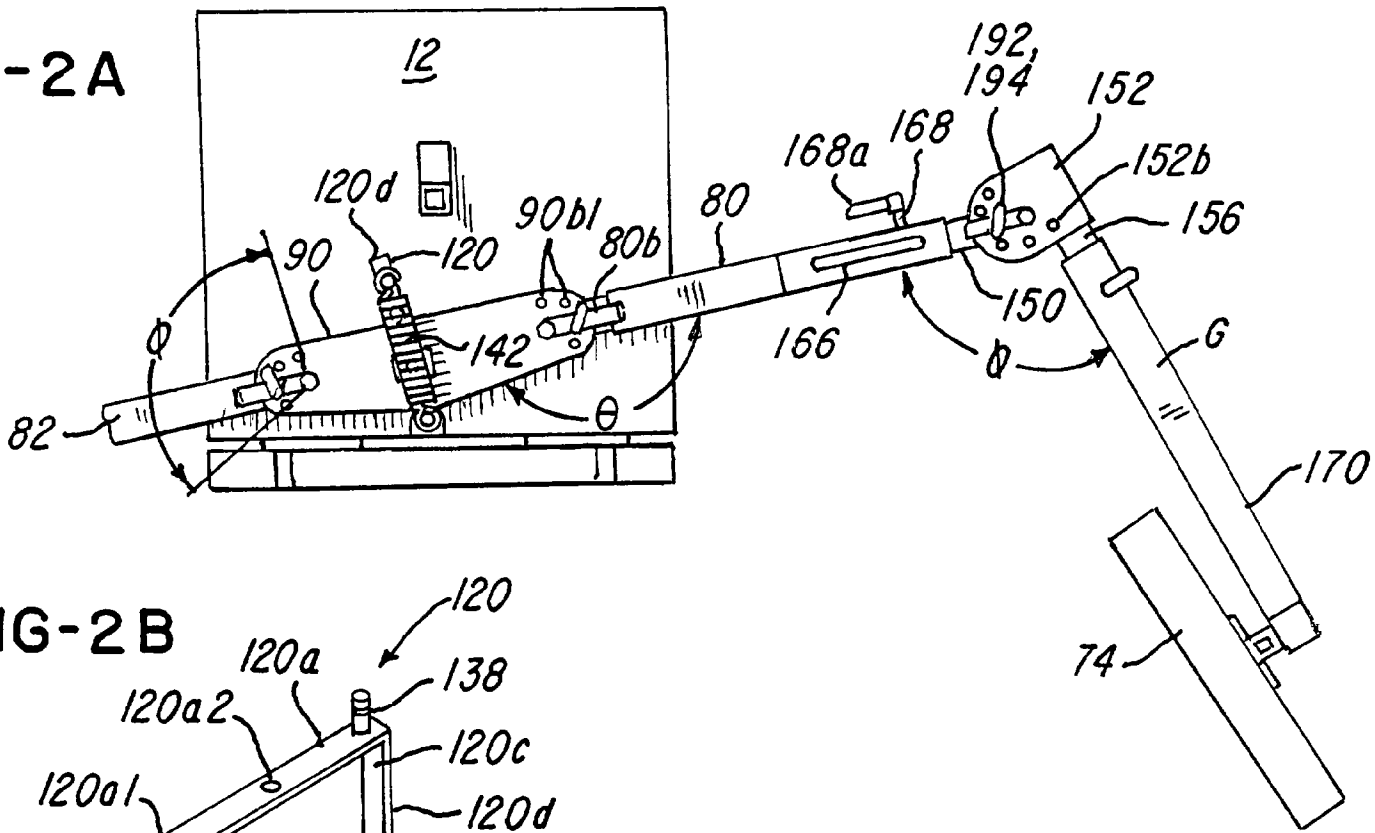
FIG. 2A is a fragmentary plan view showing features of the box-out assembly of FIG. 2.
Figure 2B:
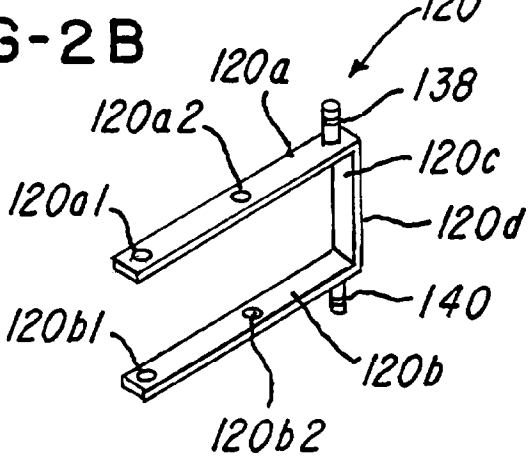
FIG. 2B is an enlarged exploded view of a U-shaped spring support of the box-out assembly of FIG. 2.

The cam or pivoting assembly 84 further comprises a U-shaped spring support 120 having a first leg member 120*a*, a second leg member 120*b* and a joining member 120*c*, as best illustrated in FIG. 2B. The leg member 120*a* comprises a pair of apertures 120*a*1 and 120*a*2 with opposing leg member 120*b* comprising opposing apertures 120*b*1 and 120*b*2. Note that the support post 104 comprises an end 104*a* having an aperture 104*a*1 which receives bolt 122 which, in turn, pivotally secures the support 120 to the support post 104. The bolt 122 is guided through the aperture 120*a*1 and also through aperture 90*a* of cam plate 90, aperture 92*a* of cam plate 92, and aperture 104*a*1 of support 104. The bolt 122 receives a washer 126 and a nut 124 is secured thereto. It should be understood that the generally U-shaped member 120 is pivotally secured to the support 104 so that the end 120*d* of U-shaped member 120 may pivot in an arc in the direction of double arrow E in FIG. 2. A second bolt 128 (FIG. 2) is guided through the apertures 120*a*2 and 120*b*2 (FIG. 2B) and secured thereto with nut 130 and washer 132.

The support 104 further comprises a first spring support post 135 (FIG. 2) and a second spring support post 136. Note also that the U-shaped member 120 (FIG. 2B) comprises the support posts 138 and 140 that are generally opposed to posts 136 and 143, respectively, as shown in FIG. 2. The posts 136 and 138 cooperate to support and retain spring 142, while posts 135 and 140 cooperate to support and retain spring 144. In the embodiment being described, the springs 142 and 144 comprise a preselected spring gauge or tension and are selected to provide a predetermined tension and to cause the box-out assembly 70 to be capable of movement and pivoting motion between a first position, illustrated in FIGS. 5 and 8, and a second position, illustrated in FIGS. 7 and 11. This permits the adjustable arms 80 and 82 to pivot or toggle in the manner shown in FIGS. 8–14 and as described later herein.

Referring back to FIGS. 2 and 2A, note that the tubular member 80 has an end 80*a* pivotally secured between cam plates 90 and 92. The tubular member 80 receives a telescoping tubular member 150 that comprises an end 150*a*. Note that end 150*a* is received between opposed supports or plates 152 and 154. The supports or plates 152 and 154 are secured to a second telescoping member 156 as shown. Note that plates or supports 152 and 154 comprise apertures 152*a* and 154*a*, respectively, that are generally opposed and that receive a bolt 158, which pivotally secures the end 150*a* between the plates or support members 152 and 154. A nut 160 having an associated washer 162 is situated on bolt 158 to lock telescoping tubular member 150 between the plates or support members 152 and 154.

The adjustable arm 80 further comprises a handle 166 on end 80*a* that may be used to grip and swivel the adjustable arm 80 and second telescoping member 156 in the manner described later herein. A bolt, lock or locking means 168 having a handle 168*a* is threadably secured to the adjustable arm 80 so that after the telescoping tubular member 150 is telescoped to a desired position in the direction of double arrow K in FIG. 2, the handle 168*a* may be actuated to lock the telescoping tubular member 150 to the adjustable arm 80.

The second telescoping member 156 further comprises a telescoping tubular member or sleeve 170 that can move or telescope in the direction of double arrow L. The member or sleeve 170 is locked to the second member 156 with the lock, threaded bolt or locking means 172 having handle 172*a* after the member 170 is moved or telescoped to the desired position relative to second member 156.

At an end 170*a* of member 170, a post 174 is secured thereto. A pad support member 176 is situated on the post 174 and may be moved in the direction of double arrow H in FIG. 2. Once the pad 74 is in the desired position, member 176 may be locked to post 174 with bolt 178 using handle 178*a* and bolt 180 using handle 180*a*.

It should be understood that the pad 74 has a wood or metal back 74*a* (FIG. 2) over which a sheer or foam padding 74*b* is secured. The pad 74 is secured directly to pad support member 176 with screws 179. Thus, when the pad support member 176 is adjusted relative to the telescoping member 170 in the direction of double arrow H, the position or height of the pad 174 may be adjusted relative to the ground. A position of the pad 74 relative to the box-out area 75 (FIG. 1) may be further adjusted by adjusting the relative position of the members 80, 150, 156 and 170.

Figure 15:
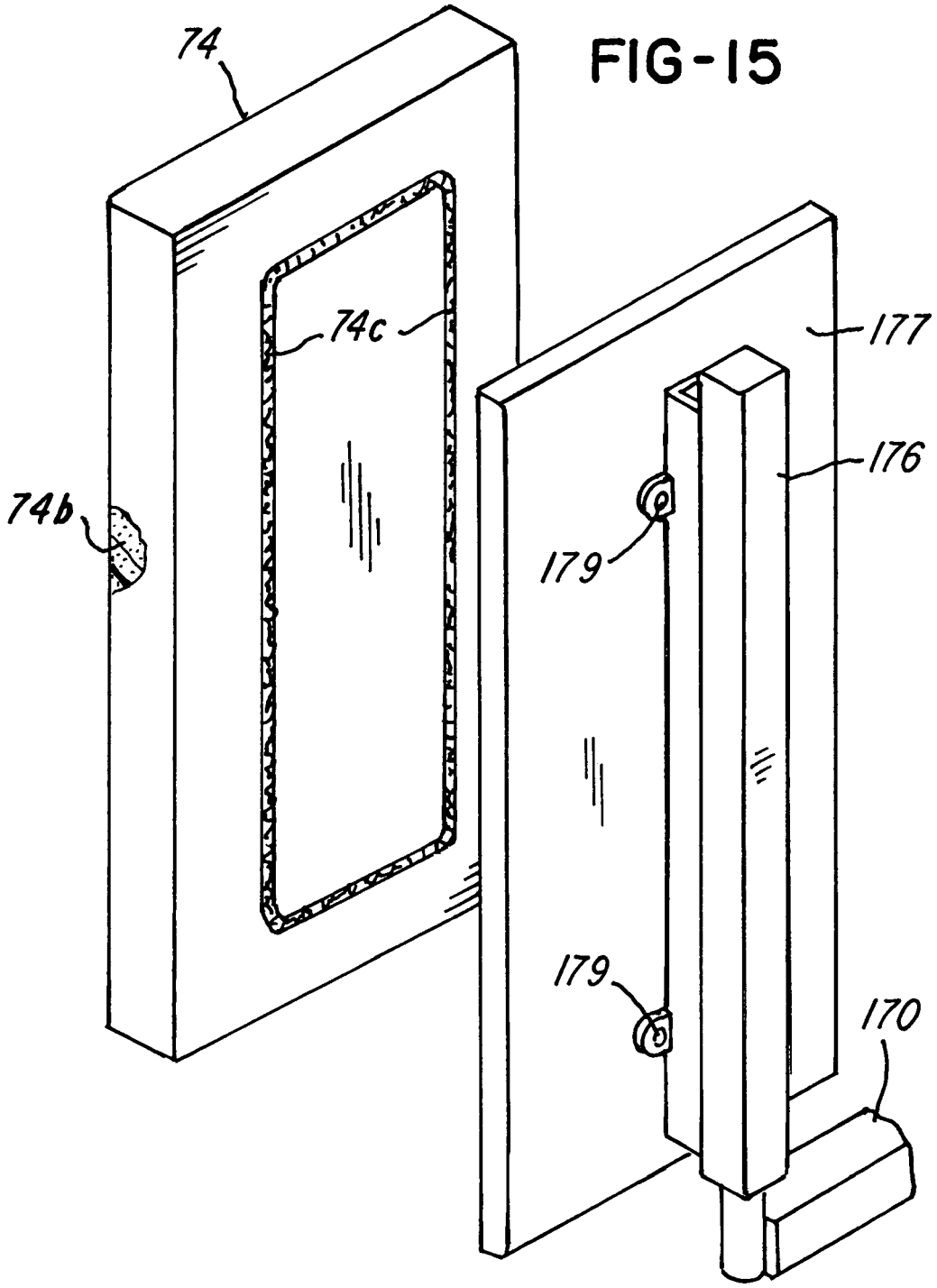
FIG. 15 is a view illustrating one form of a replaceable pad that may be used on the assembly.

As mentioned, the pad 74 may be fastened to the member 176 with screws 179, as illustrated in FIG. 2. Alternatively, the member 176 may have a permanent plate member 177 (FIG. 15) and the joining member or wing or pad 74 may be provided with an elastic edge portion 74*c* (FIG. 15) that may be slipped over the member 177 similar to the manner in which a mattress pad is slipped over a mattress. This facilitates quickly and easily changing the pads 74 to 78.

To adjust a "wingspan" of adjustable arm 80, as defined by members 80, 150, 156 and 170, the tubular member 78 comprises a lock or locking means 182 having a handle 182*a*. In the embodiment being described, the lock 182 is a threaded bolt that is screwed into a threaded opening in flange 80*b* and, ultimately, received in an aperture 90*b*1 of cam plate 90 in order to lock the adjustable arm 80 to a predetermined position in the cam plate 90. It should be understood that the adjustable arm 80 can be positioned along an arc defined by the apertures 90*b*1. This permits the members 80, 150, 156 and 170 to be positioned into a plurality of angles within the arc.

Member 150 comprises a locking flange 190 having a lock or locking means 192 having an associated handle 194. In the embodiment being described, the lock 192 is a threaded bolt that is screwed into the threaded opening in the flange 190. The lock 192 is screwed into the flange 190 until an end is received in one of the apertures 90*b*1, 152*b*. This means that the telescoping members 156 and 170 can be moved or positioned into a plurality of angular or arcuate positions along the arc defined by apertures 152*b*. For ease of illustration, only a few of the apertures 152*b* have been shown, but it should be appreciated that more or fewer apertures or even a continuous aperture (not shown) may be provided to provide numerous or substantially infinite adjusting positions which enables the position of the pad 74 to be adjusted in a plurality of different positions.

Initially, the position of the pads 74 and 78 is adjusted relative to a box-out area 75. This is accomplished by performing one or more of the following operations, which may be done in any sequence. First, the angular position θ (FIG. 2A) of the member 170 relative to the tubular member 78 may be adjusted by unlocking the lock 192 using handle 194. The telescoping member 170 is then moved along the arc mentioned earlier until it is positioned in the angle θ (FIG. 2A). The lock 192 is tightened to lock the second member 156 to the tubular member 150, as illustrated in FIGS. 1, 2 and 2A.

The telescoping tubular member 150 is then moved or telescoped in the direction of double arrow K (FIG. 2) to a desired position relative to tubular member 78 by unlocking the bolt or lock 168 by actuating the handle 168*a*. Once in the desired position, the handle 168*a* is actuated to lock the member 150 to the member 80. Similarly, the telescoping member 170 may be telescoped towards or away from the plate or support member 152 and then locked using the lock or threaded bolt 172.

If desired, the pad 74 may be moved up or down (as viewed in FIG. 2 in the direction of double arrow H) in the manner described earlier until it is at the desired position and then locked using locks 178 and 180.

The angle θ (FIG. 2A) may be further adjusted by unlocking lock 182 and moving handle 166 to move adjustable arm 80. Once in the desired position, adjustable arm 80 is locked between plates 90 and 92 by actuating lock 182.

The components of the second wing, pad adjustment assembly or adjustable arm 82 are adjusted in a manner similar to the first wing, pad adjustment assembly or adjustable arm 80 so that the joining members or wings or pads 74 and 78 are adjusted to the desired practice position relative to the box-out area 75. In this regard, it has been found that some coaches and athletes like the joining members or wings or pads 74 and 78 in "tight" to simulate a tight rebounding or box-out environment, while other coaches and athletes prefer one or more of the joining members or wings or pads 74 and 78 to be situated farther from the box-out area 75 in order to simulate a larger boxed out area.

After the joining pads 74 and 78 are adjusted relative to the box-out area 75, the system 10 may be used by the player P. One typical use of the system 10 will now be described relative to FIGS. 3–13. It should be appreciated that a feature of the invention is that it enables the player P (FIGS. 8–13) to practice boxing out an opponent player (not shown) in order to improve the players P's opportunities to capture a rebound after basketball 28 is shot towards the basketball hoop 18. To simulate the shot, one or more basketballs 28 are placed in the rebounding device 22. As mentioned earlier, the basketball 28 sits in the rebounding arm or carriage 24 (FIGS. 3 and 4) in a rest position so that the basketball 28 is suspended a predetermined distance above the ground, and this distance may be adjusted by unlocking handle 68 and adjusting the position of the supports 60 relative to the ground.

As will be described in more detail below, once the position of the rebounding arm or carriage 24 and pads 74 and 78 are adjusted to the desired position, then the player P may simulate boxing-out and grabbing a rebound by boxing-out one of the pads 74 and 78 and then grabbing the basketball 28 and pulling it downward. Note that the rebounding device 22 comprises the solenoid 26 (FIG. 3) that provides resistance during the rebound. After the height of the rebounding device 22 is adjusted, the pads 74 and 78 are adjusted to the desired position relative to box-out area 75, the player P may simulate a basketball box-out or rebounding situation in many different ways. The following will be a brief description of one possible practice drill, but it should be understood that the system 10 may be used with other practice routines as desired.

Figure 5:
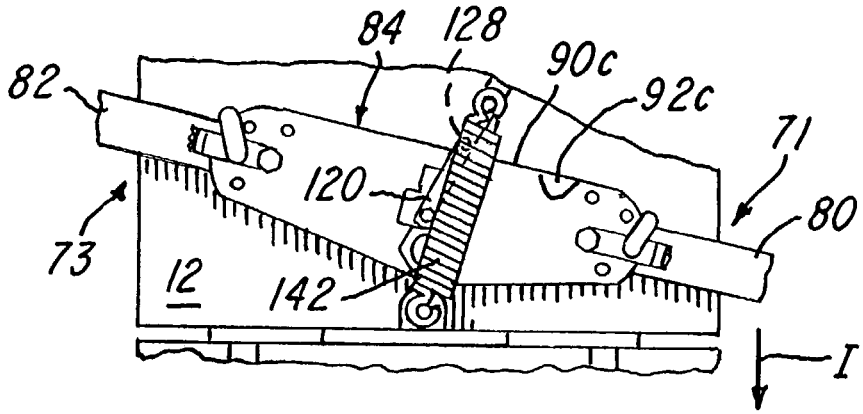
FIG. 5 is a fragmentary view illustrating various features of the box-out assembly in a position illustrated in FIG. 8.
Figure 6:
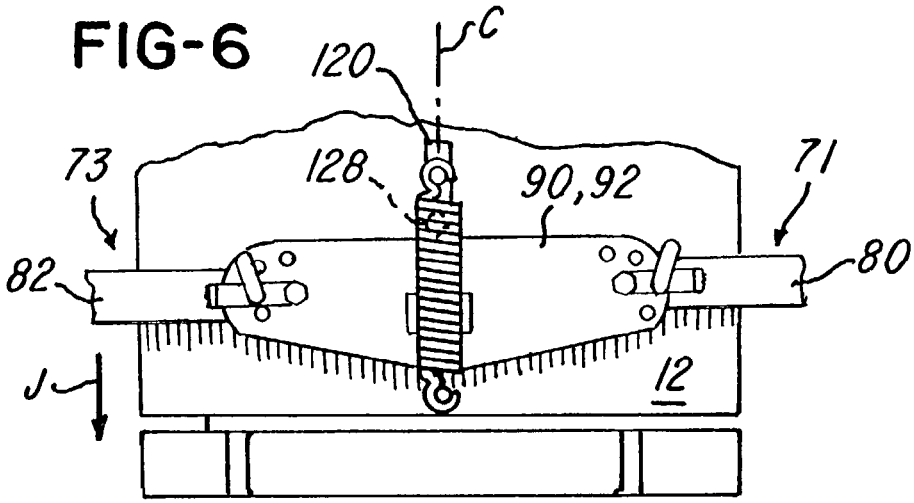
FIG. 6 is a fragmentary view illustrating various features of the box-out assembly when the assembly is in a position illustrated in FIG. 9.
Figure 8:
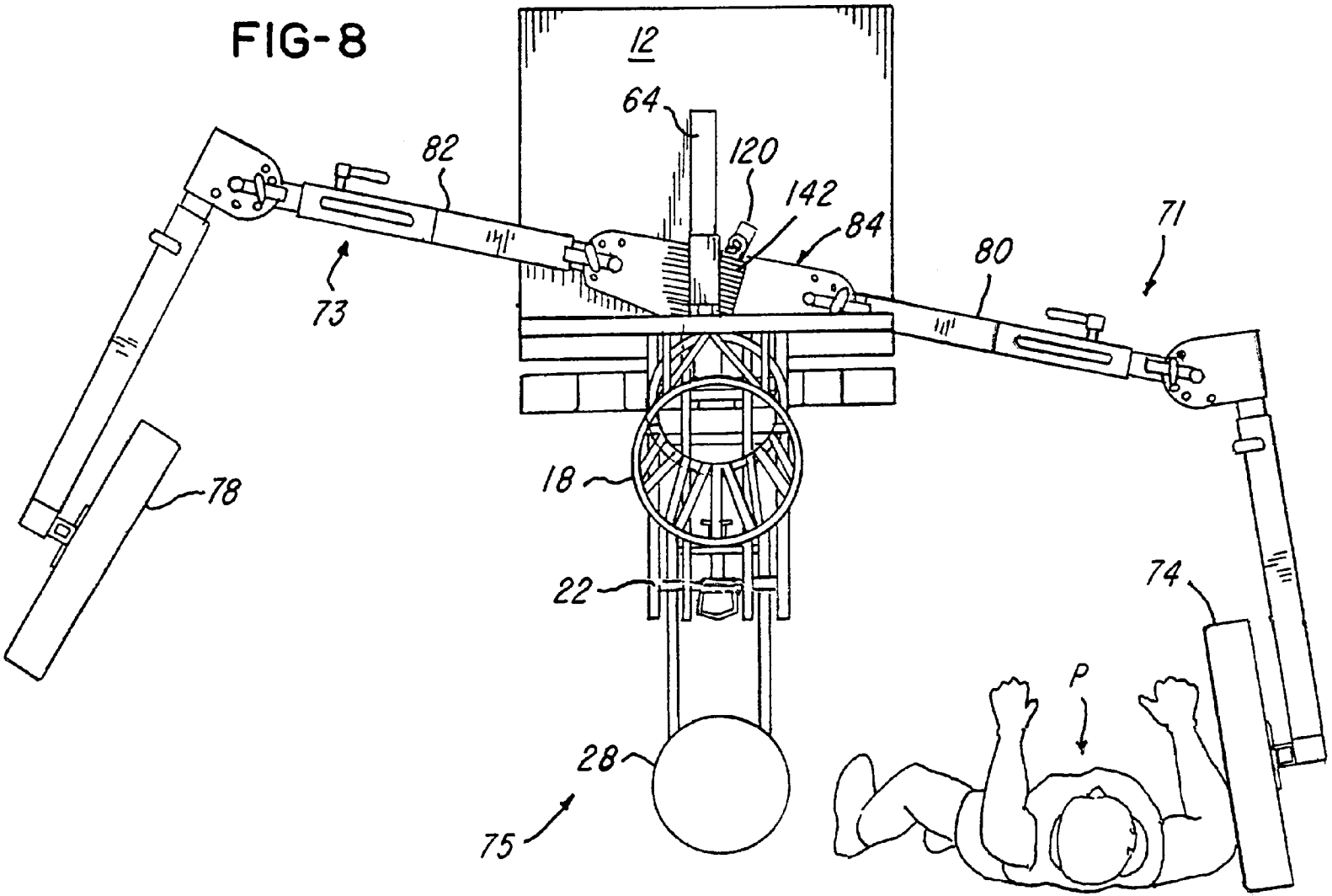
FIG. 8 is a plan view illustrating a position of the assembly when a player begins to engage a first pad.
Figure 9:
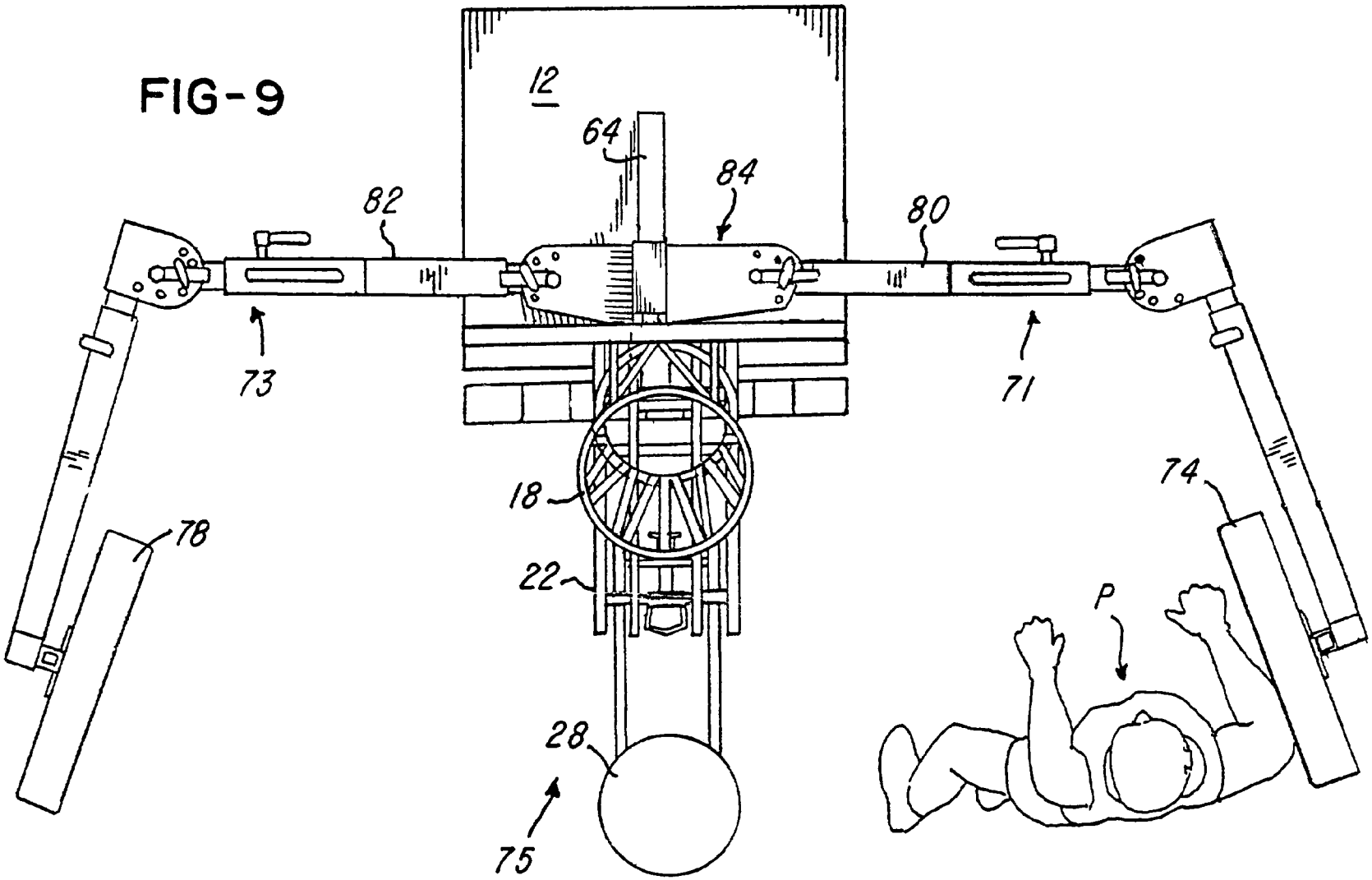
FIG. 9 is a view illustrating another position of the assembly as the player engages and moves the pad about half way through a complete cycle.
Figure 10:
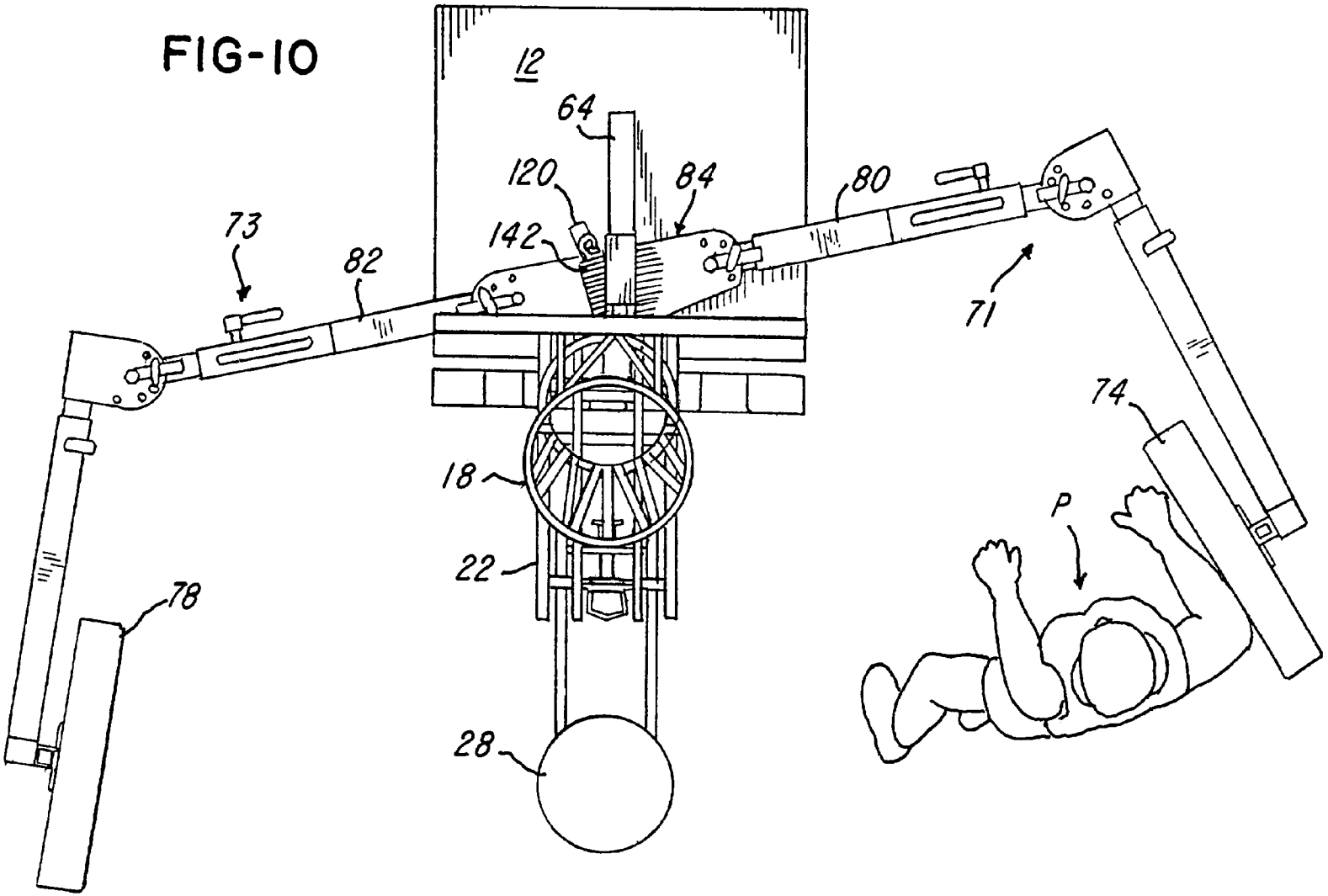
FIG. 10 is a view illustrating a position of the assembly after the player has actuated or toggled a first arm to approximately the end of a complete cycle.
Figure 11:
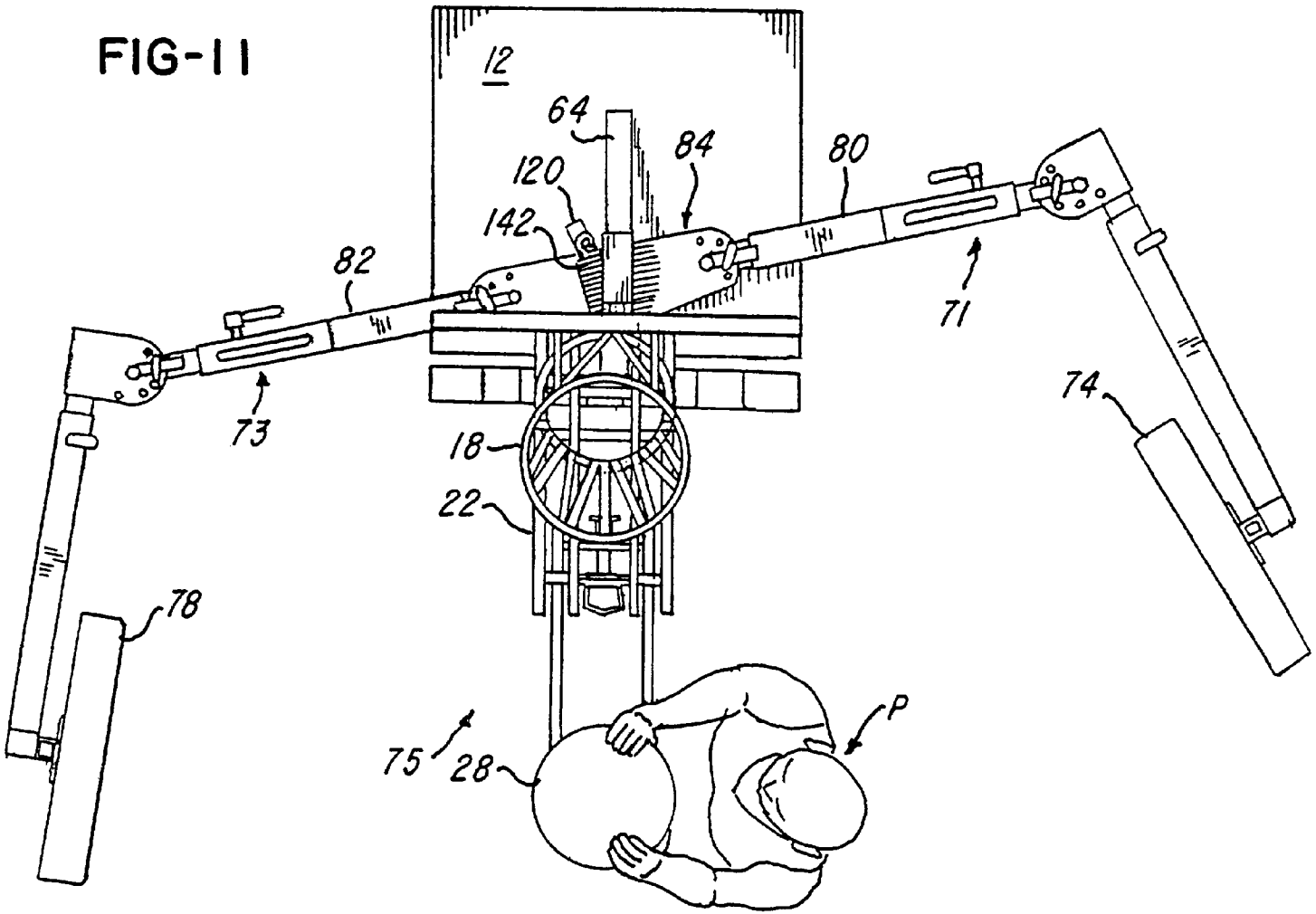
FIG. 11 is a view similar to FIG. 10 illustrating the player going up and capturing a rebound off the rebounder.
Figure 12:
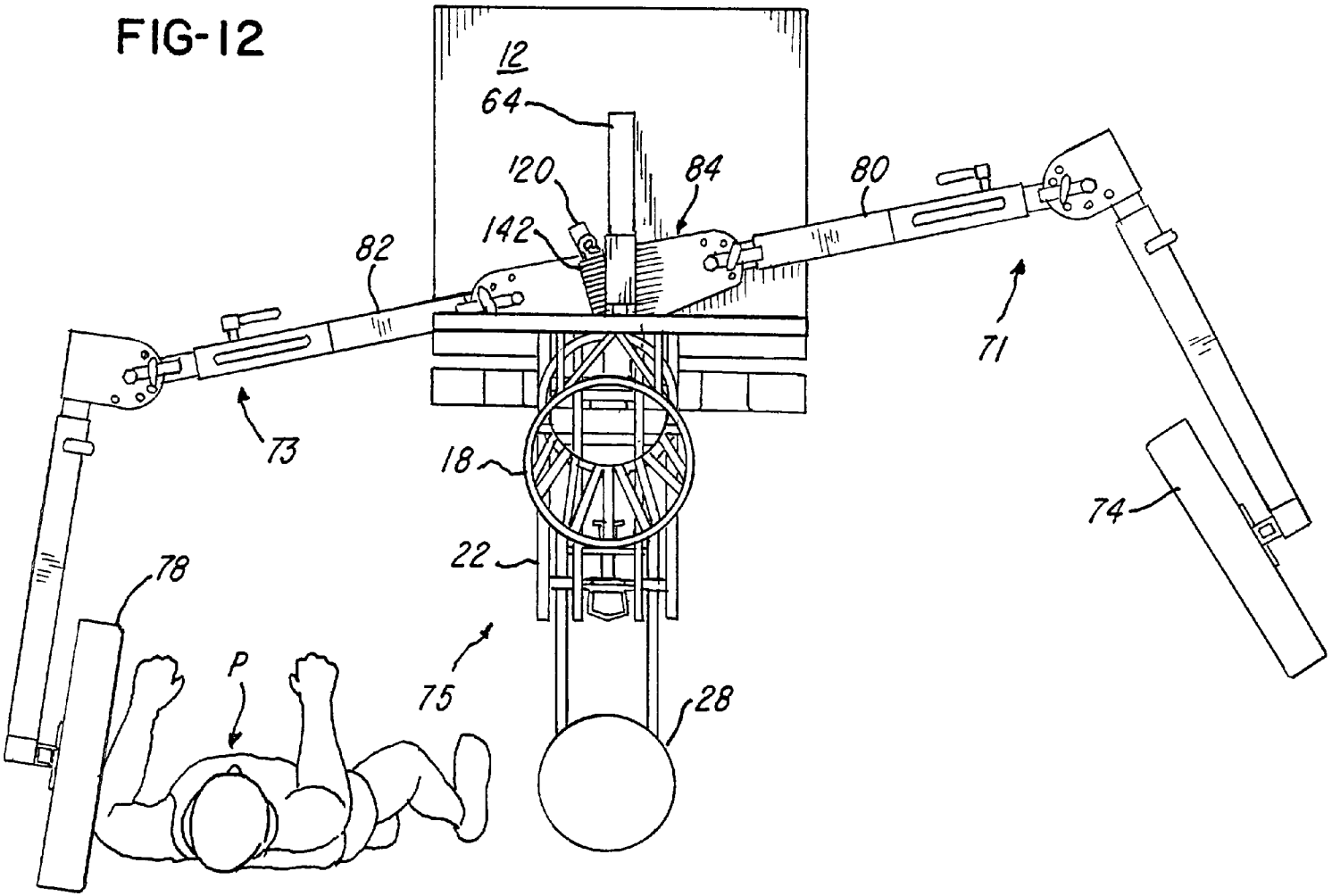
FIG. 12 is another view of the player engaging a second pad after it has been toggled toward a rebound area.
Figure 13:
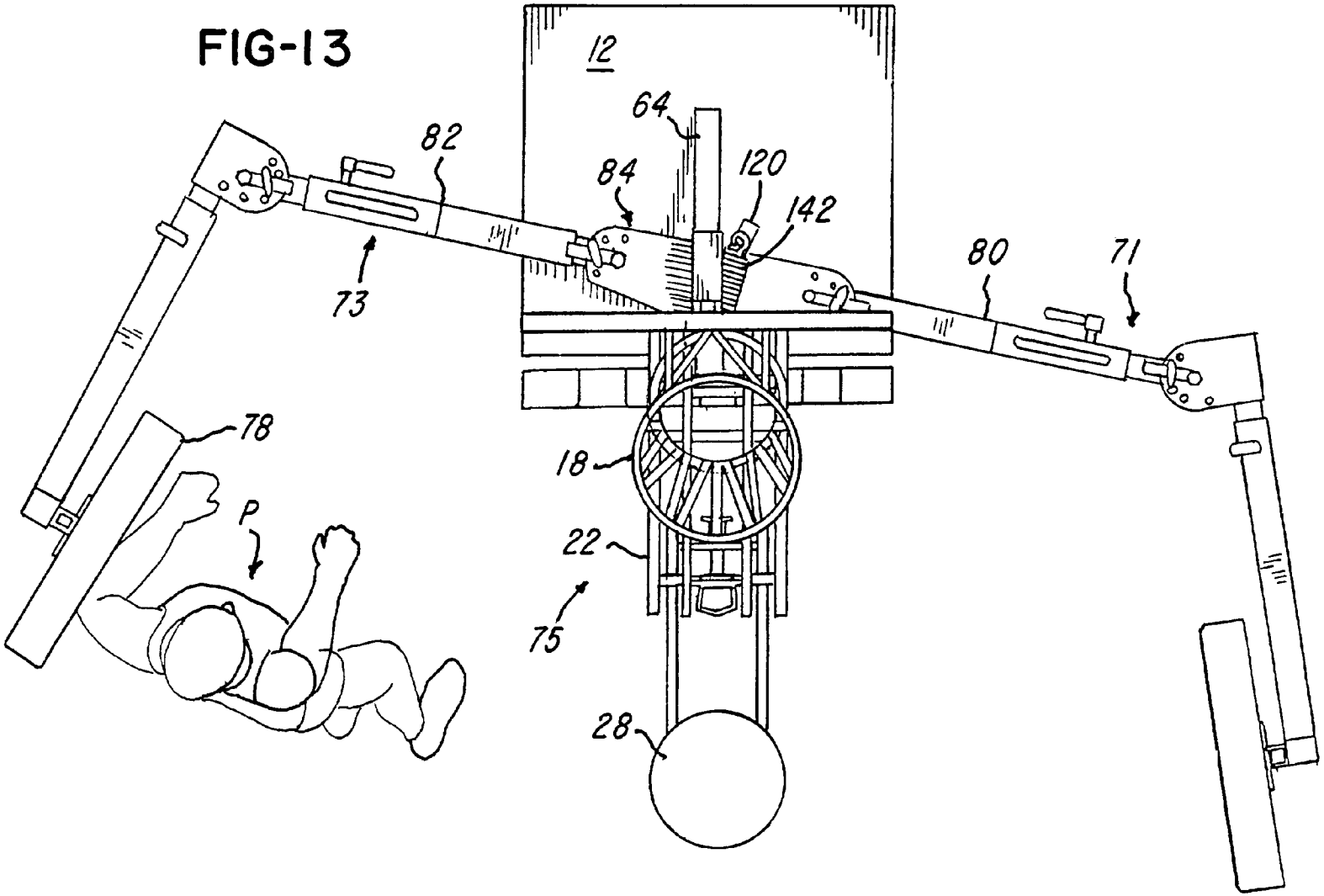
FIG. 13 is a view of the assembly system after the player has toggled a second arm to the position shown.
Figure 14:
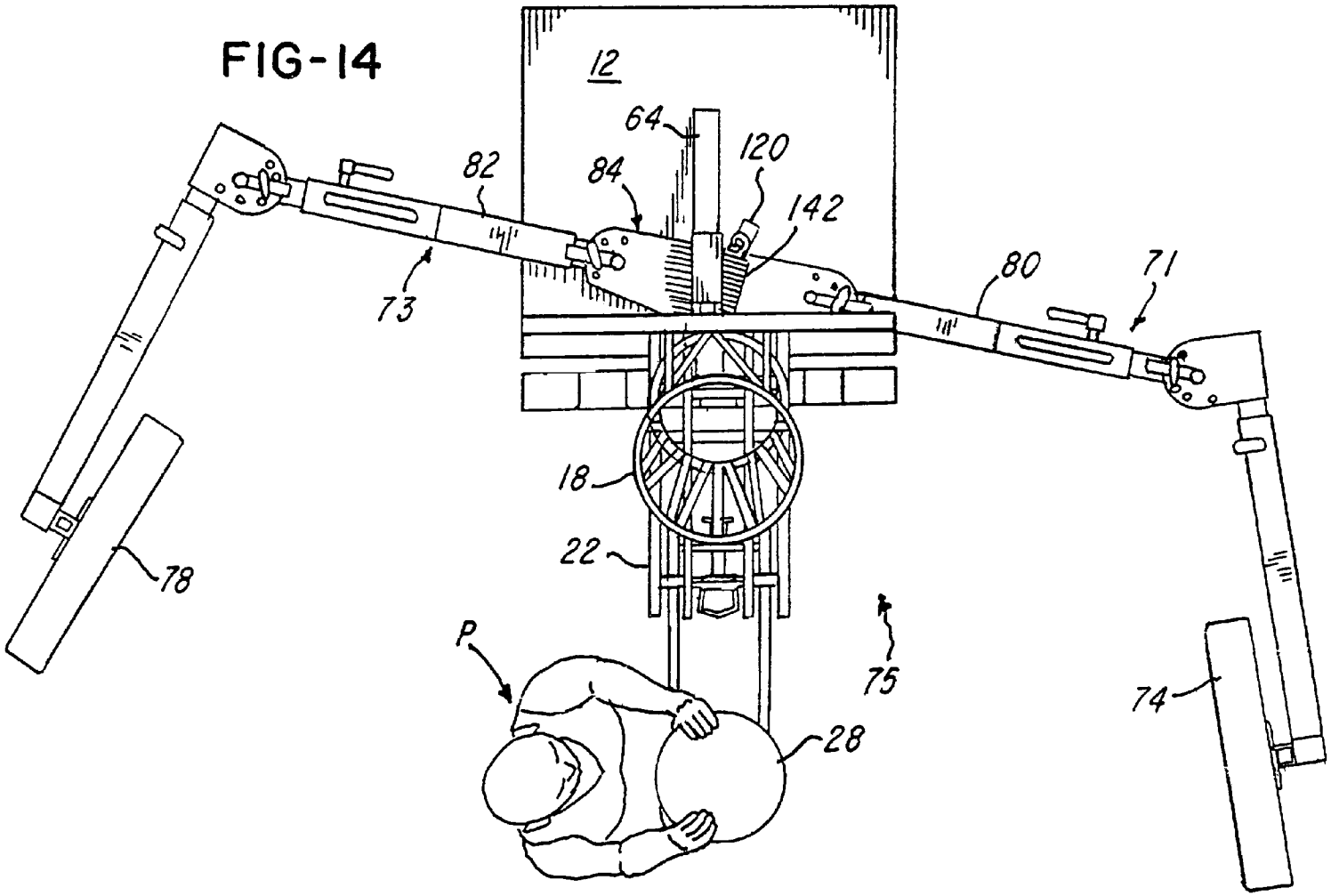
FIG. 14 is a view similar to FIG. 11, illustrating the player going up and capturing a rebound off the rebounder after the box-out maneuver illustrated in FIGS. 12 and 13 is complete.

As illustrated in FIGS. 5 and 8, note that the cam or pivoting assembly 84 is situated in a position where pad 74 is originally biased towards the box-out area 75, while pad 78 is biased further away from box-out area 75. In this regard, the springs 142 and 144 cooperate to cause the U-shaped member 120 to be biased or toggled toward the adjustable arm 80 until the bolt 128 (FIG. 2) engages edges 90*c* and 92*c*. This force causes the adjustable arm 80 to move in the direction of arrow I in FIG. 5. In the embodiment being described, the springs 142 and 144 bias the tubular member 80 in the direction of arrow I with a predetermined amount of force which is on the order of about 35 foot-pounds in the embodiment being described.

The player P then engages (FIG. 8) the pad 74 and forces it in the direction opposite that of arrow I in FIG. 5. When the force of the springs 142 and 144 is overcome, the pad 74 moves until it ultimately reaches the position shown in FIGS. 6 and 9, where adjustable arms 80 and 82 are in an equilibrium or middle position. Note that because the adjustable arms 80 and 82 are coupled to the plates 90 and 92, the pad 78 simultaneously moves or toggles toward box-out area 75 as pad 74 is moved away from box-out area 75.

Figure 7:
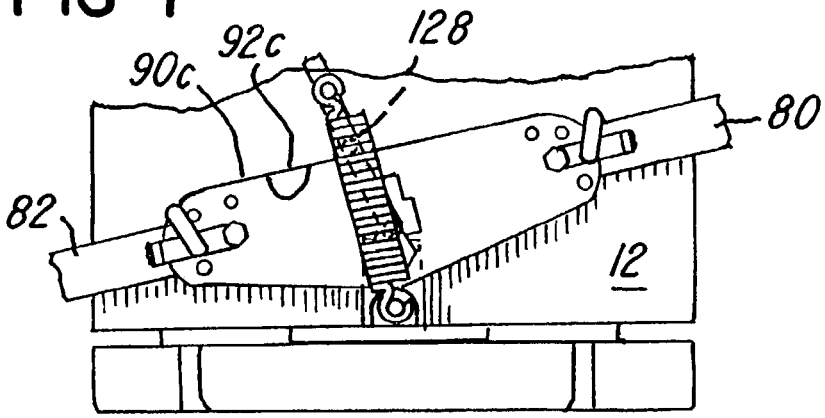
FIG. 7 is a fragmentary view showing features of the assembly when the assembly is in the position illustrated in FIG. 10.

As player P continues to drive pad 74 until U-shaped member 120 moves left of center C (as viewed in FIG. 6), the springs 142 and 144 cooperate to pull wing 73 in the direction of arrow J until the bolt 128 again engages the edges 90*c* and 92*c*, as illustrated in FIG. 7. The second wing or arm 82 continues to move in the direction of arrow J (FIG. 6) until the pad 78 is moved into the position illustrated in FIG. 10. During this movement or after the tubular member 78 is moved to the position illustrated in FIG. 10, the player P may move toward rebounder 22 or hoop 18 and simulate a rebound by grabbing the basketball 28 from carriage 24 and pulling it down, as illustrated in FIG. 3 and 4. As the rebounding arm or carriage 24 is actuated downward (FIG. 4), the arcuate pivoting stop 34 is cleared so that the second ball 28*a* can be released to "reload" carriage end 24*a* after it returns to the position shown in FIG. 3.

After the basketball 28 is rebounded, the player P may pass the basketball 28, shoot the basketball 28 toward the hoop 16, or continue practicing the box-out drill. In this regard, the conventional rebounding device 22 may be loaded with a plurality of balls so that the player P can simply discard the rebounded basketball 28 and proceed with another box-out and rebound drill. Thus, the player P may engage the pad 78 and simulate boxing out an opponent by forcing the pad 78 from the position shown in FIG. 12 to the position shown in FIG. 13. At this point, the adjustable arm or wing 82 pivots back to the position illustrated in FIGS. 8, 13 and 14. The player P again pulls down a rebound. The player P may repeat the drill as desired because the pads 74 and 78 will move or toggle towards and away from the box-out area 75. Thus, after one of the pads 74, 78 is engaged and boxed-out, the next pad 78, 74, respectively, toggles or moves toward box-out area 75 and will be ready to be engaged by the player P.

Thus, advantageously, the system and method of the invention provide a means for practicing boxing out and rebounding of a basketball 28. The first and second adjustable pad assemblies, wings, or adjustable arms 80 and 82 may be adjusted relative to their distance from the box-out area 75, as well as the angle and position of the pads 74 and 78 relative to the backboard 16. The system and method provide means for providing a predetermined resistance so that the position of the pads 74 and 78 and wings, or adjustable arms 80 and 82 may be adjusted so that the resistance provided against the player P may be altered by simply providing springs with more or less resilience. In one embodiment, the resistance is at least 35 foot pounds. Although not shown, the system 10 may comprise one or more adjustable arms 80 and 82 and may comprise a plurality of pads. The adjustable arms 80 and 82 may have more than one pad on each arm.

After the system and method are used by a Player P, the system can be conveniently stored. Alternatively, the backboard 16 may be moved into a stored position, as illustrated in phantom view in FIG. 18, so that the pads 74, 76 and 78 may be used with a backboard (not shown) that is already suspended above the ground.

Referring now to FIGS. 16–19, a rotating and pivoting system is shown. The rotating and pivoting system enables the backboard to rotate or pivot in the direction of arrow W 180 degrees to the position shown in phantom view in FIGS. 16 and 17.

Figure 19:
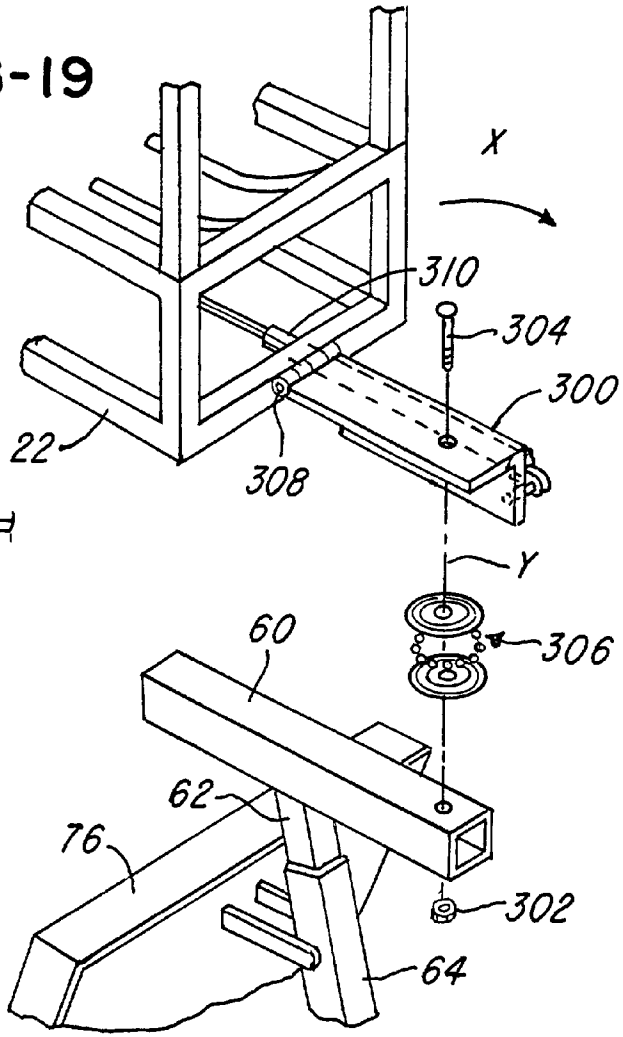
FIG. 19 is an exploded view showing a pivot and rotating system for enabling the backboard to rotate and pivot downwards.

FIG. 19 illustrates a pivot member 300 that is in the form of an L-shaped bracket that is mounted to support 60 with a nut 302 in bolt 304 as illustrated. A bearing race 306 is situated between the bracket 300 and support 60. As illustrated in FIG. 19, the bearing race 306 enables the rebounder 22, backboard 16 and associated hoop 18 to pivot or rotate in the direction of arrow X about the axis Y. Note the rebounder 22 is pivotally mounted to the bracket 300 with a hinge or pivot member 308.

Figure 16:
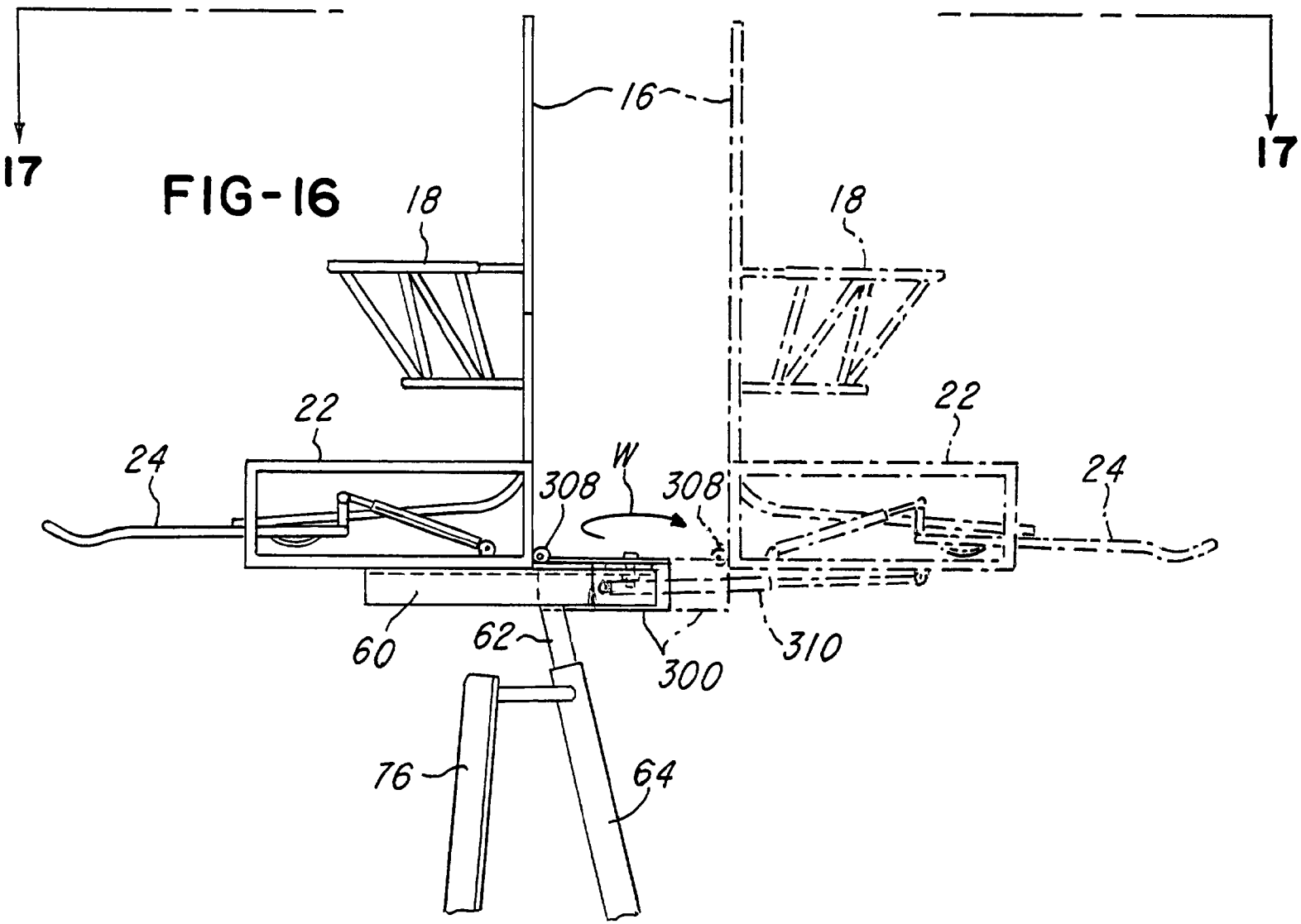
FIG. 16 is a view showing a pivoting feature of the invention.
Figure 17:
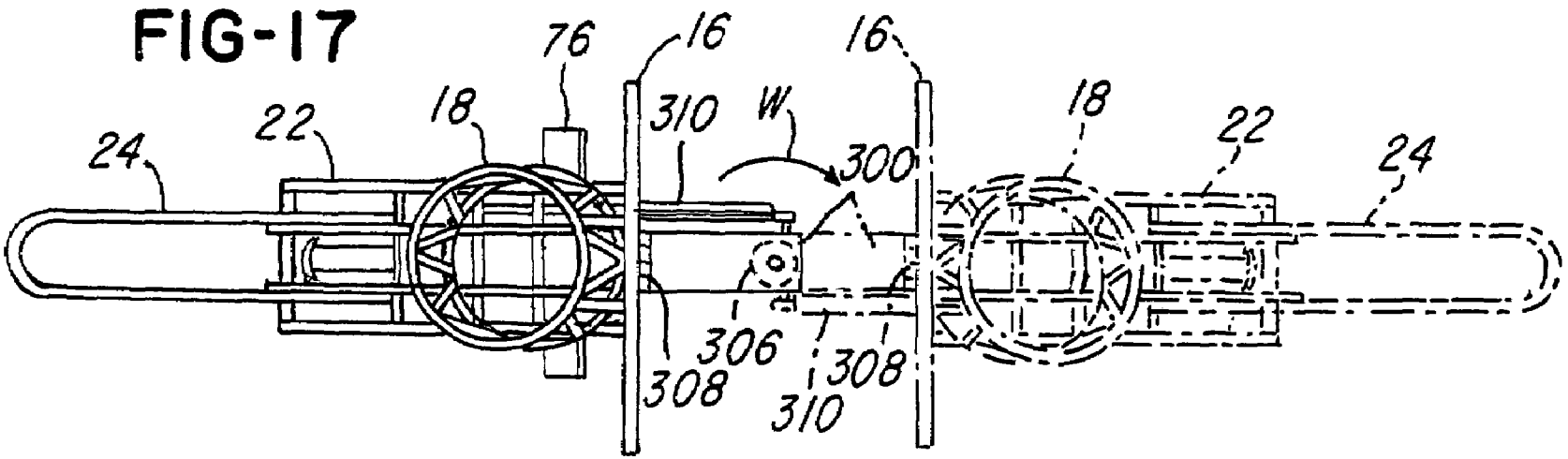
FIG. 17 is a plan view similar to FIG. 16 taken along the line 17—17 in FIG. 16.

As best illustrated in FIGS. 16 and 17, the bearing race 306 enables the rebounder 22, backboard 16 and rim or hoop 18 to pivot in the direction of arrow W to the position shown in phantom so that the backboard 16 faces away from the pads 74, 76 and 78. Once in this position, the rebounder 22 may pivot in the direction of arrow Z (FIG. 18) about an axis of hinge 308 so that the rebounder 22 moves from a position shown in FIG. 18 to the phantom position shown in FIG. 18. In this position, the backboard 16, hoop 18 and rebounder 22 are in a stored position.

The system 10 may comprise a cylinder 310 (FIGS. 18 and 19) that facilitates moving the backboard 16, hoop 18 and rebounder 22 from the upright position to the stored position. Also, although not shown, a latch or locking mechanism may be provided to lock the backboard 16, hoop 18 and rebounder 22 into the upright position shown in FIGS. 16 and/or in the stored position illustrated in FIG. 18.

Figure 18:
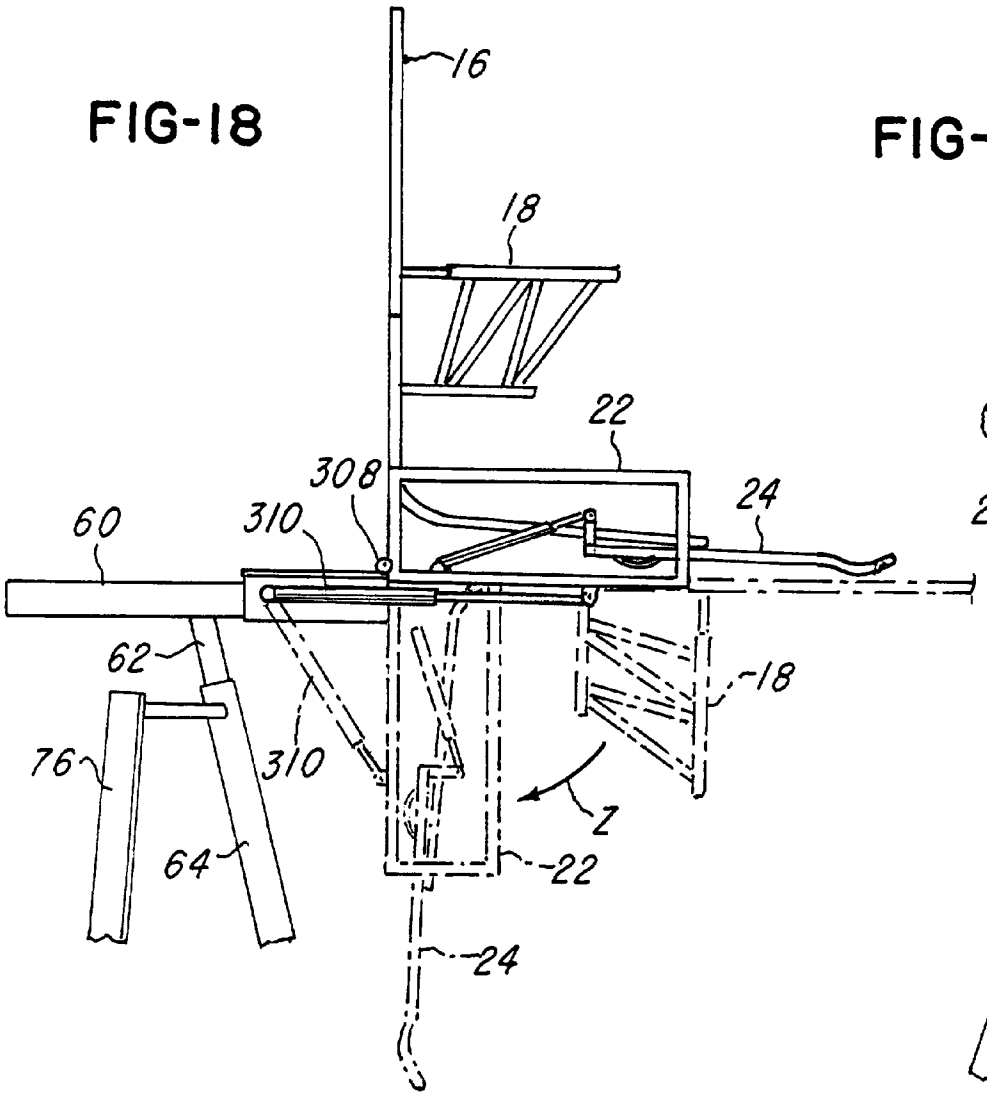
FIG. 18 is a view illustrating the basketball backboard moving to a stored position.

Advantageously, this rotating and pivoting feature of the invention enables the upper portion of the box-out assembly to be folded into a stored position illustrated in FIG. 18. This facilitates storing the box-out assembly or, alternatively, enables the assembly to be used underneath a conventional basketball backboard that is already suspended above the ground.

As mentioned earlier herein, the invention may be used with or without the rebounder 22, backboard 16, hoop 18 and the like. The base 12 is portable and can be moved to any desired position, such as under an existing basketball hoop, where the invention may be used.

In addition to a box-out drill, the invention may be used as with a shooting drill. For example, the Player P in FIG. 8 can hold a basketball, while driving the pad 74 to the position shown in FIG. 9, whereupon the Player P would then shoot the basketball 28 toward the hoop 18 in order to simulate a shot under the hoop with opponent pressure from the side or rear. This use of the invention facilitates practicing shooting from under or around the hoop 18 under pressure either before or after a rebound.

While the method herein described, and the form of apparatus for carrying this method into effect, constitute preferred embodiments of this invention, it is to be understood that the invention is not limited to this precise method and form of apparatus, and that changes may be made in either without departing from the scope of the inventions, which is defined in the appended claims.

The invention claimed is:

1. A basketball practice system comprising the following elements in combination:

a base;

at least one support coupled to the base;

a rebounder coupled to said at least one support for holding a basketball above the ground; and a resistance assembly adjustably coupled to said at least one support; said resistance assembly comprising a first resistance member that provides a predetermined amount of resistance to said player when said player engages said at least one resistance member; said first resistance member moving in a substantially non-vertical direction when said player engages said first resistance member with a force that exceeds said predetermined amount of resistance, said rebounder holding the basketball above the ground so that a player can grab the basketball and pull it downward toward the ground before or after engaging said first resistance member.

2. The basketball practice system as recited in claim 1 wherein said first resistance member comprises an arm on which a pad is supported.

3. The basketball practice system as recited in claim 2 wherein said arm is adjustable to change a position of said pad relative to a box-out area.

4. The basketball practice system as recited in claim 2 wherein said arm comprises at least one telescoping member.

5. The basketball practice system as recited in claim 2 wherein said arm comprises a plurality of telescoping members.

6. The basketball practice system as recited in claim 1 wherein said resistance assembly comprises a second resistance member that provides a second predetermined amount of resistance to said player when said player engages said second resistance member; said second resistance member moving substantially non-vertically when said player engages said second resistance member with a force that exceeds said second predetermined amount of resistance.

7. The basketball practice system as recited in claim 6 wherein said first and second resistance members are coupled to a pivot member that permits both of said first and second resistance members to pivot about a pivot axis when said player engages either of said first and second resistance members.

8. The basketball practice system as recited in claim 7 wherein each of said first or second resistance members comprise an adjustable arm that is pivotally attached to said pivot member, said resistance assembly comprising a first and second lock associated with said first and second resistance members for locking said first or second resistance members to said pivot member.

9. The basketball practice system as recited in claim 8 wherein each of said adjustable arms comprise at least one telescoping member to facilitate changing a position of said first or second resistance members relative to said box-out area.

10. The basketball practice system as recited in claim 2 wherein said resistance assembly comprises a second arm on which a second pad is supported.

11. The basketball practice system as recited in claim 10 wherein said arm and said second arm are adjustable to permit a change of position of said pad and said second pad relative to said box-out area.

12. The basketball practice system as recited in claim 11 wherein each of said arm and said second arm comprises at least one telescoping member.

13. The basketball practice system as recited in claim 11 wherein said arm comprises a plurality of telescoping members.

14. The basketball practice system as recited in claim 1 wherein said system further comprises a basketball backboard and hoop coupled to said support and in operative relationship with said rebounder.

15. The basketball practice system as recited in claim 8 wherein said system further comprises a basketball backboard and hoop coupled to said support.

16. The basketball practice system as recited in claim 1 wherein said predetermined amount of resistance is at least 35 foot pounds.

17. The basketball practice system as recited in claim 6 wherein said first and second predetermined amount of resistance is at least 35 foot pounds.

18. The basketball as recited in claim 1 wherein said resistance assembly is a box-out assembly.

19. The basketball practice system as recited in claim 1 wherein at least one of said backboard or said rebounder is pivotally mounted to said support to enable movement to a storage position.

20. A basketball practice system comprising:

a base;

at least one support coupled to the base;

a resistance assembly coupled to said at least one support; said resistance assembly comprising a first resistance member that provides a predetermined amount of resistance to a player when said player engages said at least one resistance member; said first resistance member moving in a substantially non-vertical direction when said player engages said first resistance member with a force that exceeds said second predetermined amount of resistance;

wherein said resistance assembly comprises a second resistance member that provides a second predetermined amount of resistance to a player when said player engages said second resistance member; said second resistance member moving substantially non-vertically when said player engages said second resistance member with a force that exceeds said predetermined amount of resistance;

wherein said first and second resistance members are coupled to a pivot member that permits both of said first and second resistance members to pivot about a pivot axis when said player engages either of said first and second resistance members; and wherein when said player engages one of said first or second resistance members to move said one of said first or second resistance members to a boxed-out position away from a box-out area, the other of said first or second resistance members moves toward said box-out area.

21. The basketball practice system as recited in claim 20 wherein said pivot member causes said one of said first or second resistance members to remain in said boxed-out position in response to said player engaging said one of said first or second resistance members.

22. The basketball practice system as recited in claim 20 wherein said pivot member causes said one of said first or second resistance members to remain in said boxed-out position in response to said player engaging said one of said first or second resistance members while causing the other of said first or second resistance members to remain in an engagement-ready position relative to said box-out area.

23. The basketball practice system as recited in claim 22 wherein said pivot member comprises a cam member and at least one spring for biasing at least one of said first or second resistance members into said boxed-out position and the other of said first or second resistance members in said engagement-ready position.

24. A basketball practice apparatus comprising the following elements in combination:

a base;

a support extending upward away from said base and comprising a backboard and rim situated above the ground in proximity to a box-out area;

a rebounder coupled to said support for holding a basketball above the ground so that a player can grab the basketball and pull it downward toward the ground; and a box-out apparatus adjustably associated with said box-out area;

said box-out apparatus permitting a player to simulate boxing out a second player or shooting under pressure from the second player by providing at least one resistance member that yields to said player when said player applies a predetermined amount of pressure to said at least one resistance member, said at least one resistance member moving substantially laterally in any direction when said player engages said at least one resistance member with a force that exceeds said predetermined force.

25. The basketball practice apparatus as recited in claim 24 wherein said at least one resistance member comprises an arm on which a pad is supported.

26. The basketball practice apparatus as recited in claim 25 wherein said arm is adjustable to change a position of said pad relative to said box-out area.

27. The basketball practice apparatus as recited in claim 25 wherein said arm comprises at least one telescoping member.

28. The basketball practice apparatus as recited in claim 25 wherein said arm comprises a plurality of telescoping members.

29. The basketball practice apparatus as recited in claim 24 wherein said box-out apparatus comprises a first resistance member and a second resistance member, each providing a predetermined amount of resistance to said player when said player engages said first and second resistance members.

30. The basketball practice apparatus as recited in claim 29 wherein said first and second resistance members are coupled to a pivot member that permits both of said first and second resistance members to pivot about a pivot axis when said player engages either of said first and second resistance members.

31. A basketball practice apparatus comprising:

a base;

a support extending upward away from said base and comprising a backboard and rim situated above the ground in proximity to a box-out area; and a box-out apparatus associated with said box-out area;

said box-out apparatus permitting a player to simulate boxing out a second player or shooting under pressure from the second player by providing at least one resistance member that yields to said player when said player applies a predetermined amount of pressure to said at least one resistance member, said at least one resistance member moving substantially laterally in any direction when said player engages said at least one resistance member with a force that exceeds said predetermined force;

wherein said box-out apparatus comprises a first resistance member and a second resistance member, each providing a predetermined amount of resistance to said player when said player engages said first and second resistance members; said first and second resistance members are coupled to a pivot member that permits both of said first and second resistance members to pivot about a pivot axis when said player engages either of said first and second resistance members; and wherein when said player engages one of said first or second resistance members to move said one of said first or second resistance members to a boxed-out position away from said box-out area, the other of said first or second resistance members moves toward said box-out area.

32. A basketball practice apparatus comprising:

a base;

a support extending upward away from said base and comprising a backboard and rim situated above the ground in proximity to a box-out area; and a box-out apparatus associated with said box-out area;

said box-out apparatus permitting a player to simulate boxing out a second player or shooting under pressure from the second player by providing at least one resistance member that yields to said player when said player applies a predetermined amount of pressure to said at least one resistance member, said at least one resistance member moving substantially laterally in any direction when said player engages said at least one resistance member with a force that exceeds said predetermined force;

wherein said box-out apparatus comprises a first resistance member and a second resistance member, each providing a predetermined amount of resistance to said player when said player engages said first and second resistance members; said first and second resistance members are coupled to a pivot member that permits both of said first and second resistance members to pivot about a pivot axis when said player engages either of said first and second resistance members; and wherein said pivot member causes said one of said first or second resistance members to remain in said boxed-out position in response to said player engaging said one of said first or second resistance members.

33. A basketball practice apparatus comprising:

a base;

a support extending upward away from said base and comprising a backboard and rim situated above the ground in proximity to a box-out area; and a box-out apparatus associated with said box-out area;

said box-out apparatus permitting a player to simulate boxing out a second player or shooting under pressure from the second player by providing at least one resistance member that yields to said player when said player applies a predetermined amount of pressure to said at least one resistance member, said at least one resistance member moving substantially laterally in any direction when said player engages said at least one resistance member with a force that exceeds said predetermined force;

wherein said box-out apparatus comprises a first resistance member and a second resistance member, each providing a predetermined amount of resistance to said player when said player engages said first and second resistance members;

said first and second resistance members are coupled to a pivot member that permits both of said first and second resistance members to pivot about a pivot axis when said player engages either of said first and second resistance members; and wherein said pivot member causes said one of said first or second resistance members to remain in said boxed-out position in response to said player engaging said one of said first or second resistance members while causing the other of said first or second resistance members to remain in an engagement-ready position relative to said box-out area.

34. The basketball practice apparatus as recited in claim 33 wherein said pivot member comprises a cam member and at least one spring for biasing at least one of said first or second resistance members into a boxed-out position and the other of said first or second resistance members in said engagement ready position.

35. The basketball practice apparatus as recited in claim 33 wherein each of said first or second resistance members comprise an adjustable arm that is pivotally attached to said pivot member, said box-out apparatus comprising a first and second lock associated with said first and second resistance members for locking said first or second resistance members to said pivot member.

36. The basketball practice apparatus as recited in claim 35 wherein each of said adjustable arms comprise at least one telescoping member to facilitate changing a position of said first or second resilient members relative to said box-out area.

37. The basketball practice apparatus as recited in claim 25 wherein said box-out apparatus comprises a second arm on which a second pad is supported.

38. The basketball practice apparatus as recited in claim 37 wherein said arm and said second arm are adjustable to permit a change of position of said pad and said second pad relative to said box-out area.

39. The basketball practice apparatus as recited in claim 38 wherein each of said arm and said second arm comprises at least one telescoping member.

40. The basketball practice apparatus as recited in claim 37 wherein each of said arm and said second arm comprise a plurality of telescoping members.

41. The basketball practice apparatus as recited in claim 24 wherein said rebounder is situated in operative relationship with said rim.

42. The basketball practice apparatus as recited in claim 24 wherein said predetermined amount of resistance is at least 35 foot pounds.

43. The basketball practice apparatus as recited in claim 34 wherein said at least one spring comprises a wire gauge and diameter selected such that said first and second predetermined amount of resistance is at least 35 foot pounds.

44. A method for improving rebounding skills, comprising the steps of:

providing a base comprising a support extending upward away from said base and comprising a backboard and hoop situated above the ground in proximity to a box-out area, said support has a rebounder coupled to said support for holding a basketball above the ground;

providing a box-out apparatus coupled to said support associated with the box-out area; and enabling a player to simulate boxing out a second player by providing at least one resistance member that yields to said player when said player applies a predetermined amount of pressure to said at least one resistance member, said at least one resistance member moving in a substantially non-vertical or lateral direction when said player engages said at least one resistance member with a force that exceeds said predetermined force either before or after said player obtains or receives said basketball from said rebounder as said rebounder holds the basketball above ground.

45. The method as recited in claim 44 wherein said method further comprises the step of providing at least one resistance member comprising an arm on which a pad is supported.

46. The method as recited in claim 45 wherein said method further comprises the step of adjusting said arm to change a position of said pad relative to said box-out area.

47. The method as recited in claim 45 wherein said arm comprises at least one telescoping member, said method further comprising the step of telescoping said at least one telescoping member to change said position.

48. The method as recited in claim 45 wherein said arm comprises a plurality of telescoping members, said method further comprising the step of telescoping said plurality of telescoping members to change said position.

49. The method as recited in claim 44 wherein said resistance assembly comprises a first resistance member and a second resistance member, each providing a predetermined amount of resistance to said player, each of said first resistance members and said second resistance members yielding in said substantially non-vertical or lateral direction when said player engages them.

50. The method as recited in claim 49 wherein said method comprises the steps of coupling said support to a pivot member that permits both of said first and second resistance members to pivot about a pivot axis when said player engages either of said first and second resistance members and locking said first and second resistance member to said pivot member.

51. A method for improving rebounding skills, comprising the steps of:

providing a base comprising a support extending upward away from said base and comprising a backboard and hoop situated above the ground in proximity to a box-out area; and providing a box-out apparatus associated with the box-out area;

enabling a player to simulate boxing out a second player by providing at least one resistance member that yields to said player when said player applies a predetermined amount of pressure to said at least one resistance member, said at least one resistance member moving in a substantially non-vertical or lateral direction when said player engages said at least one resistance member with a force that exceeds said predetermined force;

wherein said resistance assembly comprises a first resistance member and a second resistance member, each providing a predetermined amount of resistance to said player, each of said first resistance members and said second resistance members yielding in a substantially non-vertical or lateral direction when said player engages them wherein said method comprises the steps of coupling said support to a pivot member that permits both of said first and second resistance members to pivot about a pivot axis when said player engages either of said first and second resistance members and locking said first and second resistance member to said pivot member;

wherein when said player engages one of said first or second resistance members to move said one of said first or second resistance members to a boxed-out position away from said box-out area, the other of said first or second resistance members move toward said box-out area.

52. A method for improving rebounding skills, comprising the steps of:

providing a base comprising a support extending upward away from said base and comprising a backboard and hoop situated above the ground in proximity to a box-out area;

providing a box-out apparatus associated with the box-out area; wherein said box-out apparatus comprises a first resistance member and a second resistance member, each providing a predetermined amount of resistance to said player, each of said first resistance members and said second resistance members yielding in said substantially non-vertical or lateral direction when said player engages them;

enabling a player to simulate boxing out a second player by providing at least one resistance member that yields to said player when said player applies a predetermined amount of pressure to said at least one resistance member, said at least one resistance member moving in a substantially non-vertical or lateral direction when said player engages said at least one resistance member with a force that exceeds said predetermined force; and coupling said support to a pivot member that permits both of said first and second resistance members to pivot about a pivot axis when said player engages either of said first and second resistance members and locking said first and second resistance member to said pivot member; and wherein said pivot member causes said one of said first or second resistance members to remain in a boxed-out position in response to said player engaging said one of said first or second resistance members.

53. A method for improving rebounding skills, comprising the steps of:

providing a base comprising a support extending upward away from said base and comprising a backboard and hoop situated above the ground in proximity to a box-out area;

providing a box-out apparatus associated with the box-out area, wherein said box-out apparatus comprises a first resistance member and a second resistance member, each providing a predetermined amount of resistance to said player, each of said first resistance members and said second resistance members yielding in a substantially non-vertical or lateral direction when said player engages them;

enabling a player to simulate boxing out a second player by providing at least one resistance member that yields to said player when said player applies a predetermined amount of pressure to said at least one resistance member, said at least one resistance member moving in a substantially non-vertical or lateral direction when said player engages said at least one resistance member with a force that exceeds said predetermined force;

coupling said support to a pivot member that permits both of said first and second resistance members to pivot about a pivot axis when said player engages either of said first and second resistance members and locking said first and second resistance member to said pivot member; and wherein said pivot member causes said one of said first or second resistance members to remain in a boxed-out position in response to said player engaging said one of said first or second resistance members while causing the other of said first or second resistance members to remain in an engagement-ready position relative to said box-out area.

54. The method as recited in claim 53 wherein said pivot member comprises a cam member and at least one spring for biasing at least one of said first or second resistance members into a boxed-out position and the other of said first or second resistance members in said engagement ready position.

55. The method as recited in claim 53 wherein each of said first or second resistance members comprise an adjustable arm that is pivotally attached to said pivot member, said box-out apparatus comprising a first and second lock associated with said first and second resistance members for locking said first or second resistance members to said pivot member.

56. The method as recited in claim 55 wherein each of said adjustable arms comprise at least one telescoping member to facilitate changing a position of said first or second resilient members relative to said box-out area.

57. A rebound apparatus comprising the following elements in combination:

a base having a support;

a toggle member secured to said support;

a plurality of pads secured to said toggle member in operative relationship with a box-out area in proximate relationship with a hoop of a basketball backboard; and said toggle member permitting a player to engage one of said plurality of pads and to move said one of said plurality of pads away from said hoop and away from said box-out area when said player applies a predetermined amount of force to said one of said plurality of pads and substantially simultaneously and in response to the player engaging said one of said plurality of pads causing the other of said plurality of pads to move close to said hoop and said box-out area.

58. The rebound apparatus as recited in claim 57 wherein said toggle member comprises a plurality of arms having said plurality of pads secured thereto.

59. The rebound apparatus as recited in claim 58 wherein said toggle member comprises means for enabling a position of said plurality of arms to be adjusted.

60. The rebound apparatus as recited in claim 57 wherein said toggle member comprises means for permitting one of said plurality of pads to simultaneously move toward said box-out area when another of said plurality of pads is moved away from said box-out area.

61. A rebound apparatus comprising the following elements in combination:

a base having a support;

a toggle member secured to said support;

a plurality of pads secured to said toggle member in operative relationship with a box-out area in proximate relationship with a hoop of a basketball backboard; and said toggle member permitting a player to engage one of said plurality of pads and to move said one of said plurality of pads away from said hoop and away from said box-out area when said player applies a predetermined amount of force to said one of said plurality of pads and substantially simultaneously causing the other of said plurality of pads to move close to said hoop and said box-out area;

wherein said toggle member comprises means for permitting one of said plurality of pads to simultaneously move toward said box-out area when another of said plurality of pads is moved away from said box-out area; and wherein said means comprises a cam member coupled to at least one spring and have at least one of a plurality of arms secured in one a first side of the cam and another of said plurality of arms secured to a second side of said cam, each of said at least one of a plurality of arms and said another of said plurality of arms comprises a pad secured thereto.

62. The rebound apparatus as recited in claim 61 wherein said at least one of said plurality of arms and said another of said plurality of arms are adjustably secured to cam member.

63. The rebound apparatus as recited in claim 62 wherein said at cam member comprises a lock for locking said plurality of arms into a desired relationship relative to each other after a user adjusts a position of said at least one of said plurality of arms relative to another of said plurality of arms.

64. The rebound apparatus as recited in claim 57 wherein said apparatus comprises a rebounder coupled to said support.

65. The rebound apparatus as recited in claim 57 wherein said rebound apparatus comprises a rebounder coupled to said support.

* * * * *